US009164406B2

(12) United States Patent
Nishi et al.

(10) Patent No.: US 9,164,406 B2
(45) Date of Patent: Oct. 20, 2015

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Masashi Nishi, Susono (JP); Takashi Anezaki, Hiratsuka (JP); Kazuhisa Shida, Kawasaki (JP); Hirofumi Kumoi, Suntou-gun (JP); Daisuke Tanaka, Yokohama (JP); Kazumichi Sugiyama, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 14 days.

(21) Appl. No.: 14/152,438

(22) Filed: Jan. 10, 2014

(65) Prior Publication Data

US 2014/0205941 A1 Jul. 24, 2014

(30) Foreign Application Priority Data

Jan. 18, 2013 (JP) ..... 2013-007316

(51) Int. Cl.

| | |
|---|---|
| ***G03G 5/00*** | (2006.01) |
| ***G03G 5/04*** | (2006.01) |
| ***G03G 5/147*** | (2006.01) |

(Continued)

(52) U.S. Cl.

CPC ..... *G03G 5/04* (2013.01); *G03G 5/051* (2013.01); *G03G 5/056* (2013.01); *G03G 5/0514* (2013.01); *G03G 5/0517* (2013.01); *G03G 5/0521* (2013.01); *G03G 5/0564* (2013.01); *G03G 5/0589* (2013.01); *G03G 5/0592* (2013.01);

(Continued)

(58) Field of Classification Search

CPC ..... G03G 5/14756
USPC ..... 430/66
See application file for complete search history.

(56) References Cited

U.S. PATENT DOCUMENTS

| | | | |
|---|---|---|---|
| 8,080,627 | B2 | 12/2011 | Minemura et al. |
| 8,455,170 | B2 | 6/2013 | Nakamura et al. |

(Continued)

FOREIGN PATENT DOCUMENTS

| | | | |
|---|---|---|---|
| EP | 2 290 450 | A1 | 3/2011 |
| JP | 2006-328416 | A | 12/2006 |

(Continued)

OTHER PUBLICATIONS

European Search Report dated Apr. 4, 2014 in European Application No. 14151357.2.

*Primary Examiner* — Mark A Chapman
(74) *Attorney, Agent, or Firm* — Fitzpatrick, Cella, Harper and Scinto

(57) ABSTRACT

The charge transporting layer as the surface layer of an electrophotographic photosensitive member includes a charge transporting substances represented by any one of formulae (1) to (5), a specific compound, and a specific resin (binder resin). The specific compound is hexanol, heptanol, cyclohexanol, benzyl alcohol, ethylene glycol, 1,4-butanediol, 1,5-pentanediol, diethylene glycol, diethylene glycol ethyl methyl ether, ethylene carbonate, propylene carbonate, nitrobenzene, pyrrolidone, N-methylpyrrolidone, methyl benzoate, ethyl benzoate, benzyl acetate, ethyl 3-ethoxypropionate, acetophenone, methyl salicylate, dimethyl phthalate, or sulfolane.

10 Claims, 1 Drawing Sheet

(51) Int. Cl.
*G03G 5/05* (2006.01)
*G03G 5/06* (2006.01)

(52) U.S. Cl.
CPC ..... *G03G 5/0614* (2013.01); *G03G 5/0616* (2013.01); *G03G 5/14756* (2013.01)

(56) References Cited

U.S. PATENT DOCUMENTS

| | | | |
|---|---|---|---|
| 8,753,789 | B2 | 6/2014 | Ogaki et al. |
| 2012/0114375 | A1 | 5/2012 | Fujii et al. |
| 2013/0202326 | A1 | 8/2013 | Shida et al. |
| 2013/0236823 | A1 | 9/2013 | Noguchi et al. |
| 2014/0093277 | A1 | 4/2014 | Fujii et al. |

FOREIGN PATENT DOCUMENTS

| | | | |
|---|---|---|---|
| JP | 2007-47655 | A | 2/2007 |
| JP | 2007-72277 | A | 3/2007 |
| JP | 2007-79555 | A | 3/2007 |
| JP | 2007-199688 | A | 8/2007 |
| JP | 2008-195905 | A | 8/2008 |
| JP | 2010-126652 | A | 6/2010 |
| WO | 2012/057349 | A1 | 5/2012 |
| WO | 2012/074082 | A1 | 6/2012 |

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

1. Field of the Invention

The present invention relates to an electrophotographic photosensitive member, a process cartridge, and an electrophotographic apparatus.

2. Description of the Related Art

An electrophotographic photosensitive member which contains an organic photoconductive material (charge generation material) is commonly used as an electrophotographic photosensitive member mounted on an electrophotographic apparatus. Since an electrical or mechanical external force such as charging, exposure, development, transfer, and cleaning is directly applied to the surface of an electrophotographic photosensitive member when an electrophotographic apparatus repeatedly performs image formation, the surface of the electrophotographic photosensitive member needs to have durability against the external force. Furthermore, the surface of the electrophotographic photosensitive member needs to have reduced friction force (lubricity and sliding properties) applied to a contacting member (e.g. cleaning blade).

In order to have lubricity, the use of a polycarbonate resin having a specific siloxane moiety for the surface layer of an electrophotographic photosensitive member is disclosed in Japanese Patent Application Laid-Open No. 2008-195905 and Japanese Patent Application Laid-Open No. 2006-328416. In Japanese Patent Application Laid-Open No. 2010-126652, a polyester resin having a specific siloxane moiety is disclosed.

As a result of investigation by the present inventors, it was found that there is room for improvement in positive memory when a resin (polycarbonate resin or polyester resin) having a siloxane moiety at the end as disclosed in Japanese Patent Application Laid-Open No. 2008-195905, Japanese Patent Application Laid-Open No. 2006-328416, and Japanese Patent Application Laid-Open No. 2010-126652 and a charge transporting substance having a specific structure as a charge transporting substance are used.

The positive memory is a memory phenomenon caused by positive charging (charging with positive charge) of the surface of an electrophotographic photosensitive member. Examples of the situation that the surface of an electrophotographic photosensitive member is positively charged include a case that an electrophotographic photosensitive member and a charging member or a cleaning blade in contact with the electrophotographic photosensitive member are subject to sliding friction under impact due to vibration or falling in physical distribution so that positive charges are generated on the surface of the electrophotographic photosensitive member, and a case of positive charging during transferring.

SUMMARY OF THE INVENTION

An object of the present invention is to provide an electrophotographic photosensitive member which contains a charge transporting substance having a specific structure, achieving both of the reduction in initial friction force (initial friction coefficient) and the suppression of positive memory. Another object of the present invention is to provide a process cartridge and an electrophotographic apparatus each having the electrophotographic photosensitive member.

The objects are achieved by the present invention described below.

The present invention relates to an electrophotographic photosensitive member which includes: a support; a charge generating layer formed on the support; and a charge transporting layer formed on the charge generating layer; wherein the charge transporting layer is a surface layer, and the surface layer includes the following (α), (β) and (γ).

(α) is at least one charge transporting substance selected from the group consisting of a compound represented by the following formula (1), a compound represented by the following formula (2), a compound represented by the following formula (3), a compound represented by the following formula (4) and a compound represented by the following formula (5).

(β) is at least one compound selected from the group consisting of hexanol, heptanol, cyclohexanol, benzyl alcohol, ethylene glycol, 1,4-butanediol, 1,5-pentanediol, diethylene glycol, diethylene glycol ethyl methyl ether, ethylene carbonate, propylene carbonate, nitrobenzene, pyrrolidone, N-methylpyrrolidone, methyl benzoate, ethyl benzoate, benzyl acetate, ethyl 3-ethoxypropionate, acetophenone, methyl salicylate, dimethyl phthalate, and sulfolane.

(γ) is at least one resin selected from the group consisting of a polycarbonate resin having a siloxane moiety at the end, and a polyester resin having a siloxane moiety at the end.

(1)

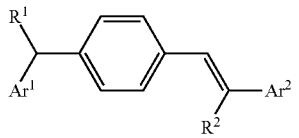

(2)

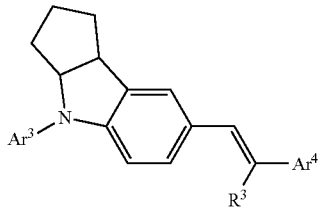

In the formula (1) and the formula (2), $Ar^1$ and $Ar^3$ each independently represent a phenyl group, or a phenyl group substituted with a methyl group, an ethyl group, or an ethoxy group. $Ar^2$ and $Ar^4$ each independently represent a phenyl group, a phenyl group substituted with a methyl group, a phenyl group substituted with a univalent group represented by the formula "—CH═CH—Ta", or a biphenylyl group substituted with a univalent group represented by the formula "—CH═CH—Ta" (where, Ta represents a univalent group derived from a benzene ring of a triphenylamine by loss of one hydrogen atom, or derived from a benzene ring of a triphenylamine substituted with a methyl group or an ethyl group by loss of one hydrogen atom). $R^1$ represents a phenyl group, a phenyl group substituted with a methyl group, or a phenyl group substituted with a univalent group represented by the formula "—CH═C($Ar^5$)$Ar^6$" (where, $Ar^5$ and $Ar^6$ each independently represent a phenyl group or a phenyl group substituted with a methyl group). $R^2$ and $R^3$ each independently represent a hydrogen atom, a phenyl group, or a phenyl group substituted with a methyl group.

(3)

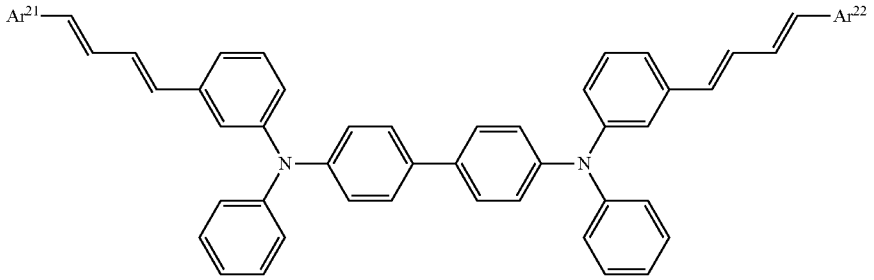

(4)

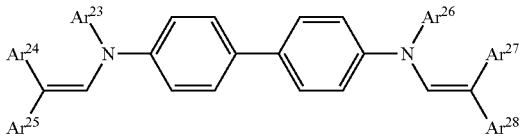

(5)

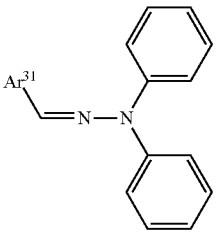

In the formula (3), $Ar^{21}$ and $Ar^{22}$ each independently represent a phenyl group, or a phenyl group substituted with a methyl group. In the formula (4), $Ar^{23}$ to $Ar^{28}$ each independently represent a phenyl group, or a phenyl group substituted with a methyl group.

In the formula (5), $Ar^{31}$ represents a phenyl group substituted with a univalent group derived from a benzene ring of a triphenylamine by loss of one hydrogen atom, a phenyl group substituted with a univalent group derived from a benzene ring of a triphenylamine substituted with a methyl group or an ethyl group by loss of one hydrogen atom, or a methylcarbazolyl group.

The present invention also relates to a process cartridge which integrally supports the electrophotographic photosensitive member and at least one device selected from the group consisting of a charging device, a developing device, a transfer device and a cleaning device, the process cartridge being detachably mountable to a main body of an electrophotographic apparatus.

The present invention also relates to an electrophotographic apparatus having the electrophotographic photosensitive member, with a charging device, an exposure device, a developing device, and a transfer device.

As described above, the present invention provides an electrophotographic photosensitive member which achieves both of the reduction in initial friction coefficient and the suppression of positive memory, and provides a process cartridge and an electrophotographic apparatus each having the electrophotographic photosensitive member.

Further features of the present invention will become apparent from the following description of exemplary embodiments with reference to the attached drawings.

DESCRIPTION OF THE EMBODIMENTS

Figure 1:
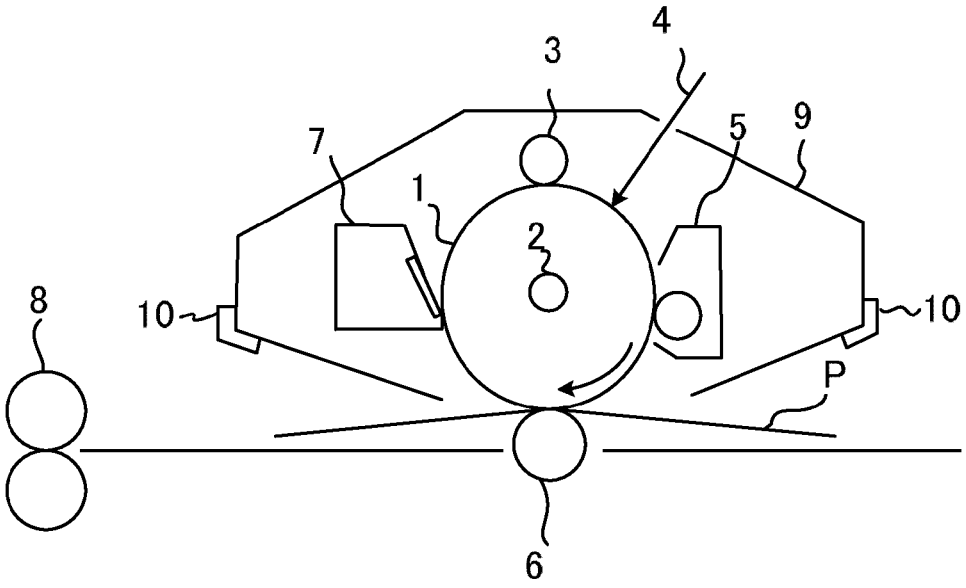
FIG. 1 is a schematic view of one example of an electrophotographic apparatus provided with a process cartridge having an electrophotographic photosensitive member.

Preferred embodiments of the present invention will now be described in detail in accordance with the accompanying drawings.

An electrophotographic photosensitive member of the present invention is provided with a charge transporting layer as a surface layer including the following (α), (β) and (γ).

(α) is at least one charge transporting substance selected from the group consisting of a compound represented by the following formula (1), a compound represented by the following formula (2), a compound represented by the following formula (3), a compound represented by the following formula (4) and a compound represented by the following formula (5).

(β) is at least one compound selected from the group consisting of hexanol, heptanol, cyclohexanol, benzyl alcohol, ethylene glycol, 1,4-butanediol, 1,5-pentanediol, diethylene glycol, diethylene glycol ethyl methyl ether, ethylene carbonate, propylene carbonate, nitrobenzene, pyrrolidone, N-methylpyrrolidone, methyl benzoate, ethyl benzoate, benzyl acetate, ethyl 3-ethoxypropionate, acetophenone, methyl salicylate, dimethyl phthalate, and sulfolane.

(γ) is at least one resin selected from the group consisting of a polycarbonate resin having a siloxane moiety at the end, and a polyester resin having a siloxane moiety at the end.

(1)

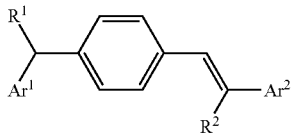

-continued (2)

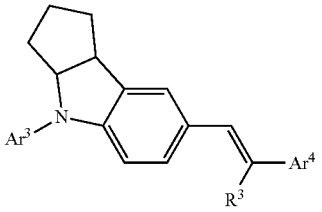

In the formula (1) and the formula (2), $Ar^1$ and $Ar^3$ each independently represent a phenyl group, or a phenyl group substituted with a methyl group, an ethyl group, or an ethoxy group. $Ar^2$ and $Ar^4$ each independently represent a phenyl group, a phenyl group substituted with a methyl group, a phenyl group substituted with a univalent group represented by the formula "—CH═CH—Ta", or a biphenylyl group substituted with a univalent group represented by the formula "—CH═CH—Ta" (where, Ta represents a univalent group derived from a benzene ring of a triphenylamine by loss of one hydrogen atom, or derived from a benzene ring of a triphenylamine substituted with a methyl group or an ethyl group by loss of one hydrogen atom). $R^1$ represents a phenyl group, a phenyl group substituted with a methyl group, or a phenyl group substituted with a univalent group represented by the formula "—CH═C($Ar^5$)$Ar^6$" (where, $Ar^5$ and $Ar^6$ each independently represent a phenyl group or a phenyl group substituted with a methyl group). $R^2$ and $R^3$ each independently represent a hydrogen atom, a phenyl group, or a phenyl group substituted with a methyl group.

triphenylamine by loss of one hydrogen atom, a phenyl group substituted with a univalent group derived from a benzene ring of a triphenylamine substituted with a methyl group or an ethyl group by loss of one hydrogen atom, or a methylcarbazolyl group.

The present inventors suppose that the surface layer of an electrophotographic photosensitive member including the (β) (hereinafter also referred to as component β) exhibits an excellent effect on both of the reduction in initial friction force (initial friction coefficient) and the suppression of positive memory due to the following reason.

Examples of the cause of positive memory include the positive charge held in a region of aggregated (α) (hereinafter also referred to as component α) as a specific charge transporting substance in a surface layer.

In order to reduce the initial friction force, the surface layer includes a resin having a siloxane moiety at the end (polycarbonate resin or polyester resin). It is believed that due to low compatibility between the resin having a siloxane moiety at the end (hereinafter also referred to as component γ) and the charge transporting substance, the aggregation of the charge transporting substance is easily caused. It is supposed that positive charge is easily held in the region of aggregated charge transporting substances, easily causing positive memory.

In the present invention, the compound (β) having higher compatibility with the component α than a resin having a siloxane moiety at the end is therefore contained. It is believed that the presence of the compound (β) prevents the (3)

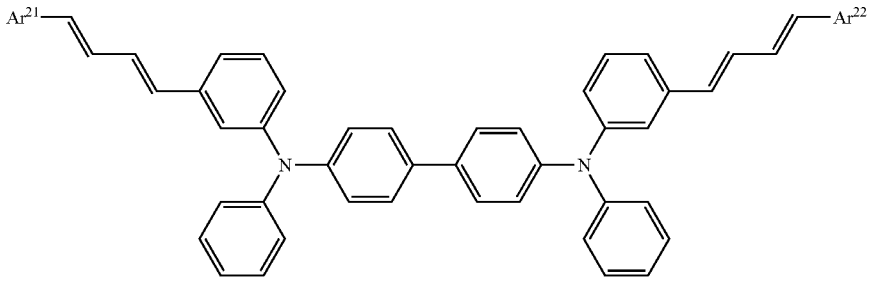

(4)

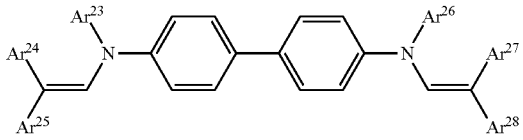

(5)

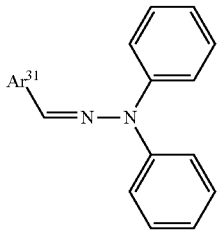

In the formula (3), $Ar^{21}$ and $Ar^{22}$ each independently represent a phenyl group, or a phenyl group substituted with a methyl group. In the formula (4), $Ar^{23}$ to $Ar^{28}$ each independently represent a phenyl group, or a phenyl group substituted with a methyl group.

In the formula (5), $Ar^{31}$ represents a phenyl group substituted with a univalent group derived from a benzene ring of a aggregation of charge transporting substances caused by the use of a resin having a siloxane moiety at the end. It is supposed that positive memory is thus suppressed.

<Component α>

Component α is the above-mentioned charge transporting substance. Specific examples of the compounds represented by the formula (1), (2), (3), (4), or (5) are as follows.

(1-1)
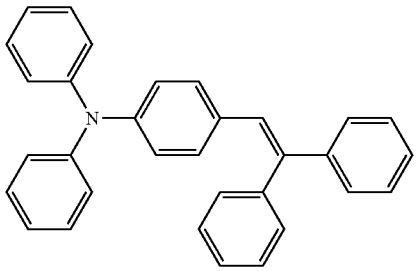
(1-2)
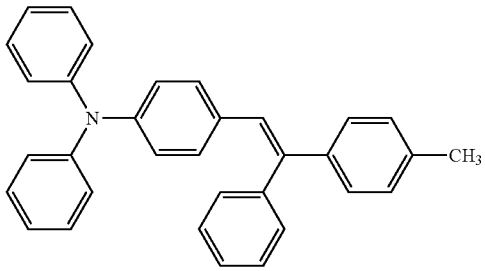
(1-3)
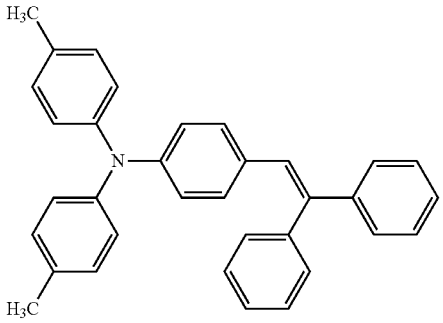
(1-4)
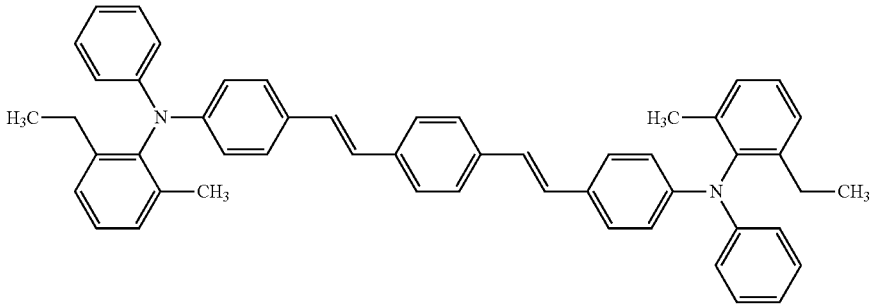
(1-5)
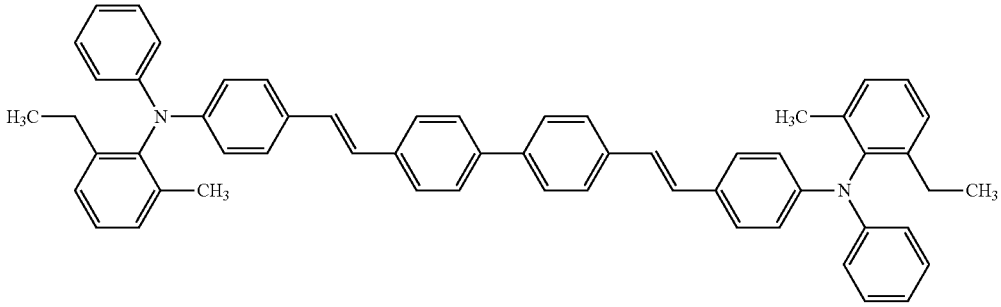
(1-6)
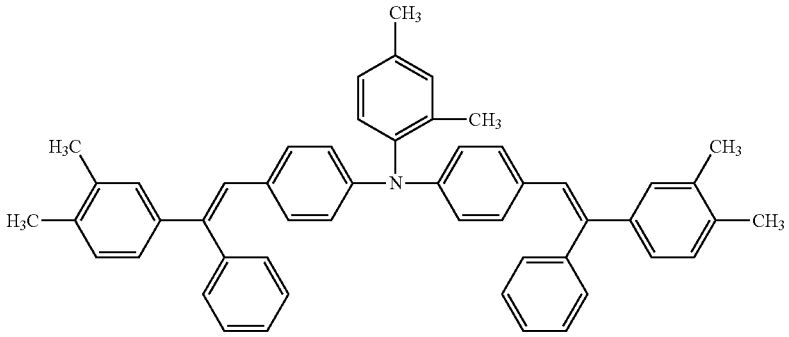

-continued
(1-7)
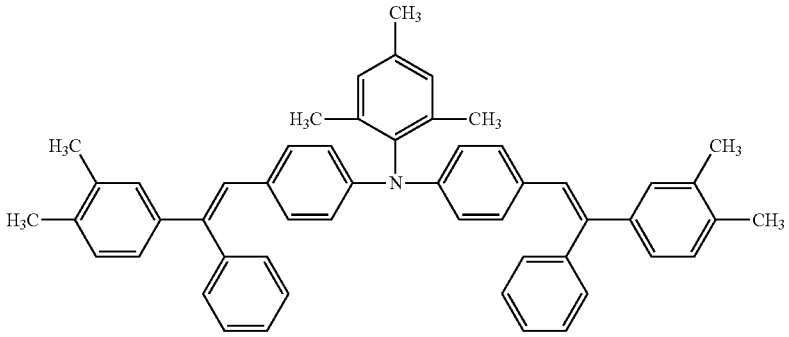
(1-8)
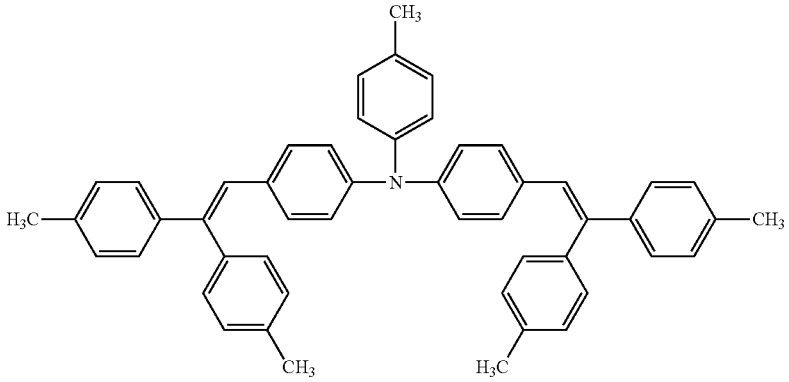
(2-1)
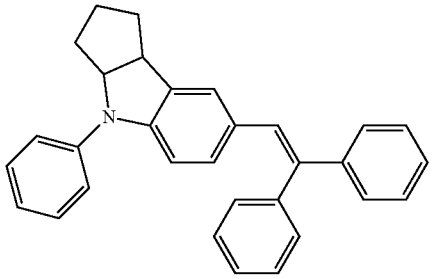
(2-2)
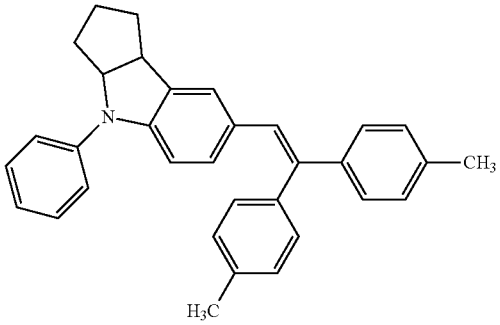
(2-3)
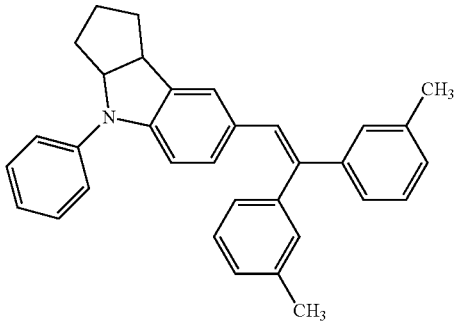
(2-4)
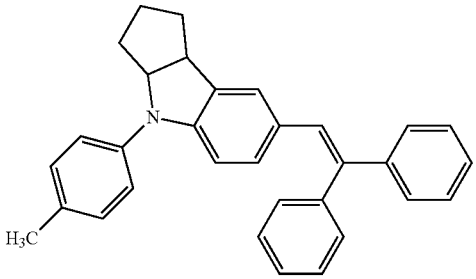

-continued
(3-1)
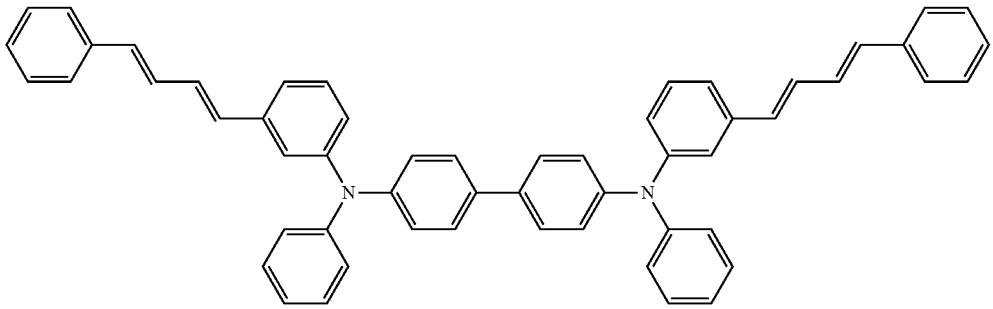
(3-2)
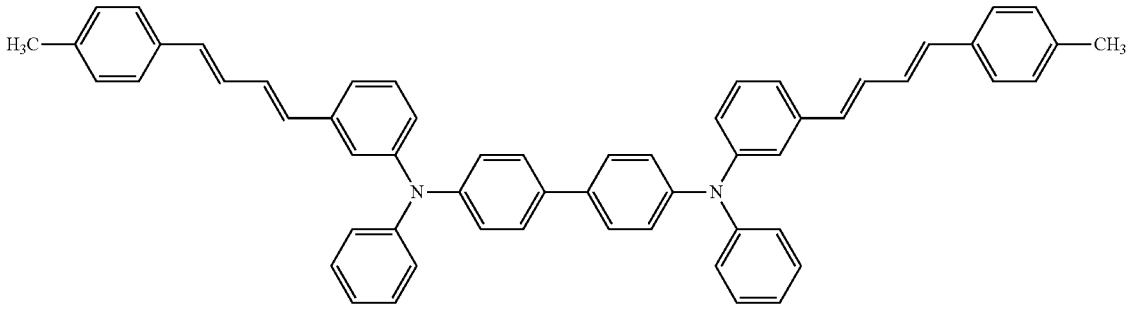
(3-3)
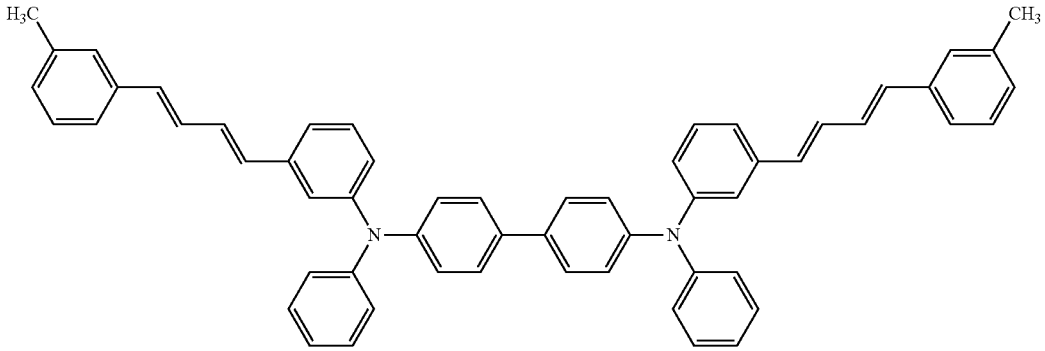
(4-1)
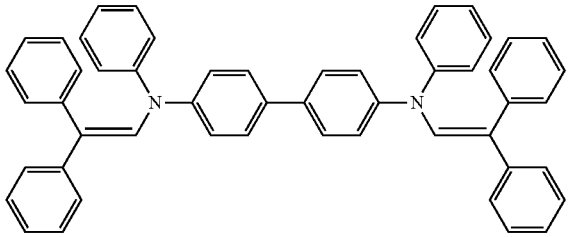
(4-2)
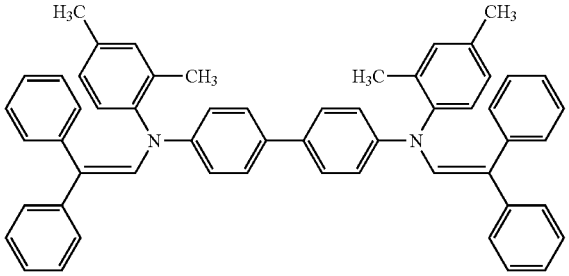
(4-3)
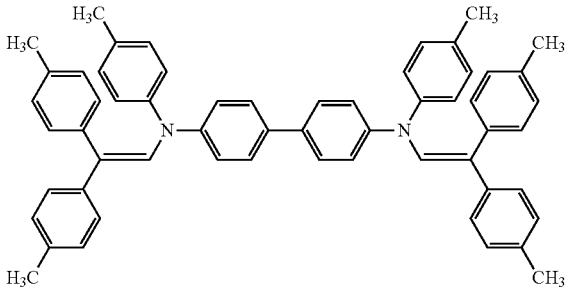
(5-1)
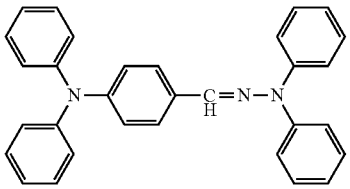

-continued (5-2)

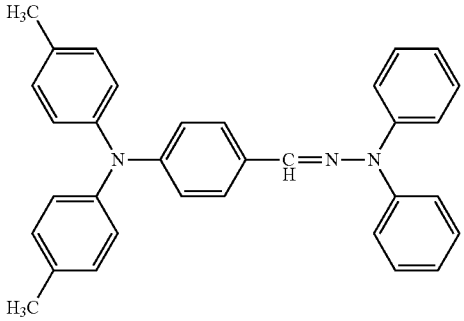

(5-3)

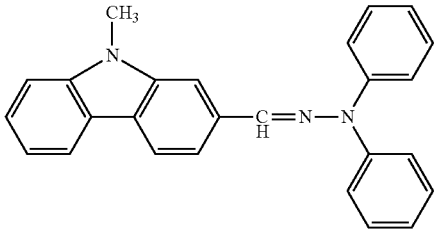

From the view point of suppressing positive memory, the content of the component α is preferably 10 mass % or more and 800 mass % or less relative to the mass of the component β, more preferably 25 mass % or more and 500 mass % or less.

<Component β>

Component β is the above-described compound.

The surface layer of an electrophotographic photosensitive member as a charge transporting layer containing the compound (component β) exhibits an effect of suppressing positive memory. The content of the component β is preferably 0.001 mass % or more and 3.0 mass % or less relative to the total mass of the surface layer, more preferably 0.001 mass % or more and 2.0 mass % or less relative to the total mass of the surface layer. In this range, both of the reduction in initial friction coefficient and the suppression of positive memory are particularly well achieved.

In the present invention, a coating film is formed from a coating liquid containing the component β for forming a surface layer, and the coating film is dried by heating so as to form a surface layer containing the component β.

Since the component β easily volatilizes in the step of heating and drying the coating film in forming the surface layer, the coating liquid for forming a surface layer preferably has a content of the component β higher than the predetermined content of the component β in the surface layer, in consideration of volatile portions. Accordingly, the content of the component β in the coating liquid for forming a surface layer is preferably 5 mass % or more and 80 mass % or less relative to the total mass of the coating liquid for forming a surface layer.

The content of the component β in the surface layer can be determined by the following measurement method.

In the present invention, the measurement was performed with an HP7694 Headspace Sampler (made by Agilent Technologies, Inc.) and an HP6890 Series GC System (made by Agilent Technologies, Inc.). In the Headspace Sampler, the oven temperature was set to 150° C., the loop temperature was set to 170° C., and the transfer line temperature was set to 190° C. A piece of 5 mm by 40 mm (sample piece) was cut out from the manufactured electrophotographic photosensitive member, placed in a vial container, and mounted in the Headspace Sampler for the measurement of generated gas with gas chromatography (HP6890 Series GC System).

The mass of the surface layer of an electrophotographic photosensitive member was determined from the difference between the mass of the sample piece having a surface layer taken out from the vial container and the mass of the sample piece of which the surface layer was detached. The sample piece of which the surface layer was detached was prepared by immersing the sample piece taken out from the vial container in methyl ethyl ketone for 5 minutes so as to detach the surface layer, which was then dried at 100° C. for 5 minutes. In the present invention, the content of the component β in the surface layer was measured by the above-mentioned method.

<Component γ (Resin Having a Siloxane Moiety at the End)>

The polycarbonate resin having a siloxane moiety at the end is preferably a polycarbonate resin D having a structural unit represented by the following formula (A) and an end structure represented by the following formula (D). The polyester resin having a siloxane moiety at the end is preferably a polyester resin E having a structural unit represented by the following formula (B) and an end structure represented by the following formula (D).

(A)

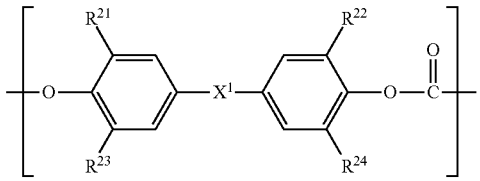

In the formula (A), $R^{21}$ to $R^{24}$ each independently represent a hydrogen atom or a methyl group. $X^1$ represents a single bond, a cyclohexylidene group, or a divalent group having a structure represented by the following formula (C).

(B)

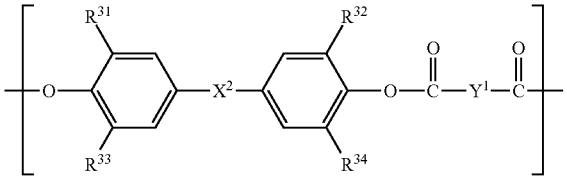

In the formula (B), $R^{31}$ to $R^{34}$ each independently represent a hydrogen atom or a methyl group. $X^2$ represents a single bond, a cyclohexylidene group, or a divalent group having a structure represented by the following formula (C). $Y^1$ represents a m-phenylene group, a p-phenylene group, or a divalent group of two p-phenylene groups bonded through an oxygen atom.

(C)

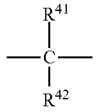

In the formula (C), $R^{41}$ and $R^{42}$ each independently represent a hydrogen atom, a methyl group, or a phenyl group.

(D)

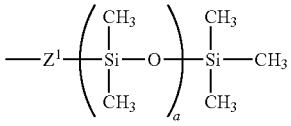

In the formula (D), a represents the number of times the structure in parentheses is repeated. The polycarbonate resin D and the polyester resin E have an average of a of 1 or more and 500 or less. $Z^1$ represents a divalent organic group.

Preferably the $Z^1$ is a divalent group represented by the following formula (E).

(E)

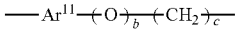

In the formula (E), $Ar^{11}$ represents a substituted or unsubstituted arylene group. The substituent of the substituted arylene group is a phenoxy group or a phenyl carbonyl group. And b represents 0 or 1, and c represents the number of times the structure in parentheses is repeated. The polycarbonate resin D or the polyester resin E has an average of c of 1 or more and 10 or less.

The specific examples of the structural unit represented by the formula (A) are as follows.

(A-1)

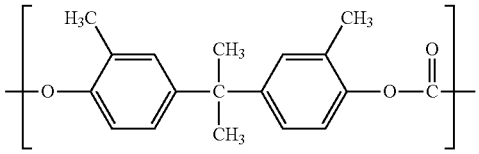

(A-2)

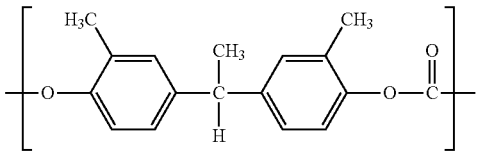

-continued (A-3)

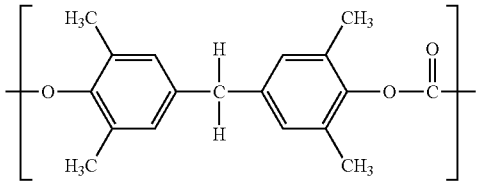

(A-4)

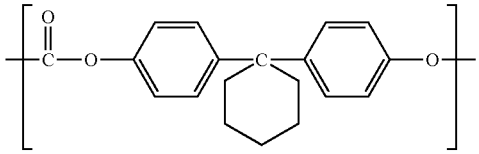

(A-5)

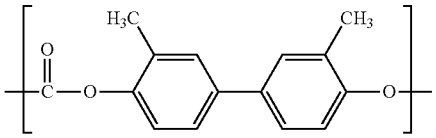

(A-6)

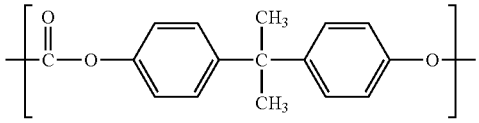

(A-7)

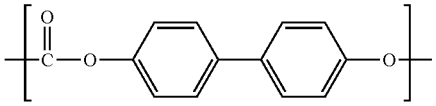

(A-8)

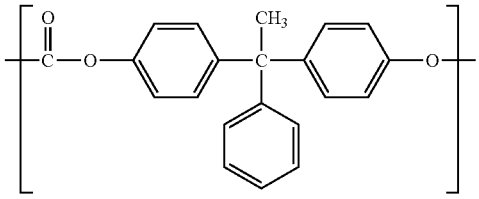

The polycarbonate resin D may be a homopolymer having only one type of repeating structural units (A-1) to (A-8) or a copolymer having two or more types of those repeating structural units. Among them, the repeating structural units represented by the formulae (A-1), (A-2) and (A-4) are preferred.

The specific examples of the structural unit represented by the formula (B) are as follows.

(B-1)

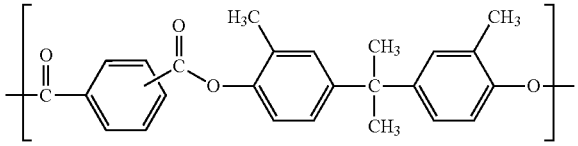

(B-2)

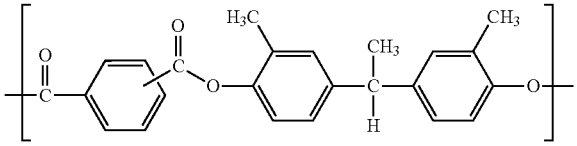

-continued (B-3)

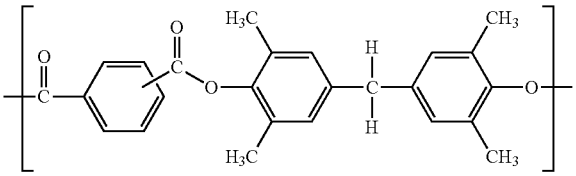

(B-4)

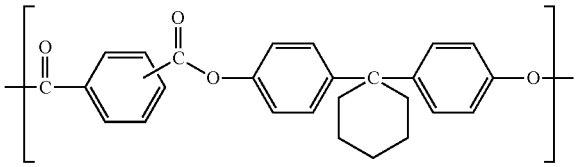

(B-5)

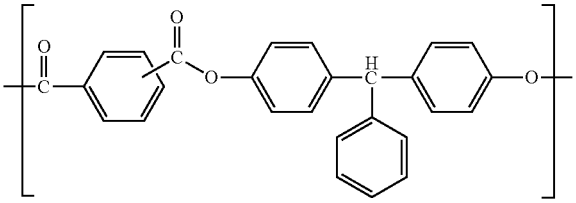

(B-6)

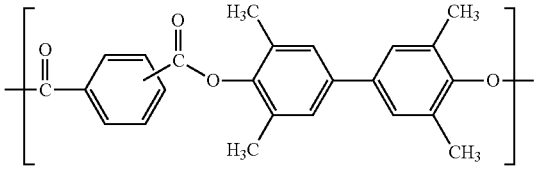

(B-7)

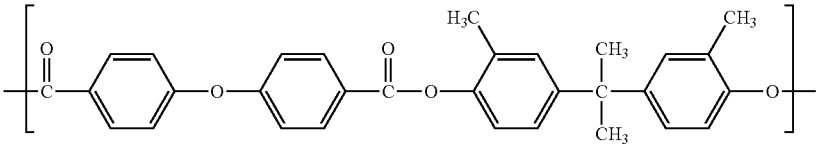

(B-8)

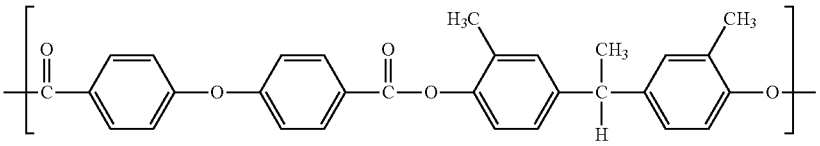

(B-9)

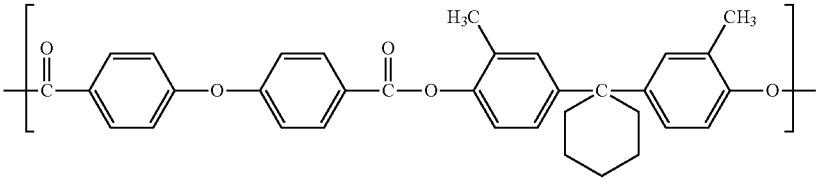

The polyester resin E may be a homopolymer having only one type of structural units represented by the (B-1) to (B-9) or a copolymer having two or more types of those structural units.

Among these, the structural units represented by the formulae (B-1), (B-2), (B-3), (B-6), (B-7) and (B-8) are preferred.

The polycarbonate resin D and the polyester resin E have an end structure represented by the formula (D) at one end or both ends of the resin. A molecular weight adjusting agent (end stopping agent) is used for a resin having an end structure represented by the formula (D) at one end of the resin. Examples of the molecular weight adjusting agent include phenol, p-cumylphenol, p-tert-butylphenol, and benzoic acid. In the present invention, phenol and p-tert-butylphenol are preferred.

The resin having an end structure represented by the formula (D) at one end has a structure of another end (another end structure) represented by the following structure.

(G-1)

(G-2)

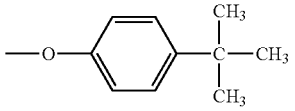

The specific examples of the end structure represented by the formula (D) are as follows.

(D-1)

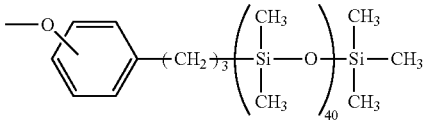

-continued (D-2)

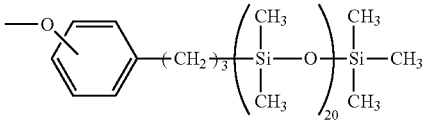

(D-3)

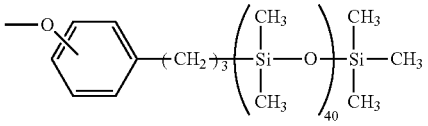

(D-4)

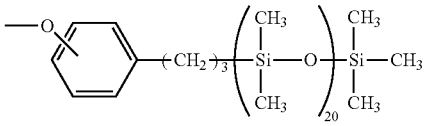

(D-5)

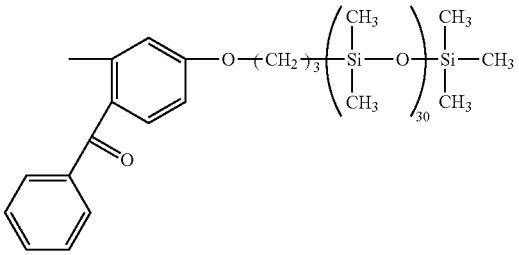

(D-6)

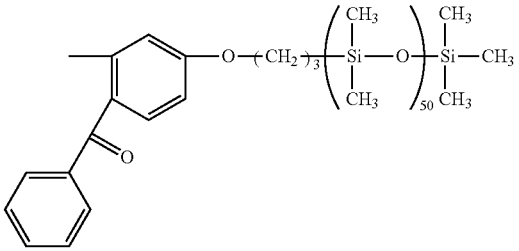

(D-7)

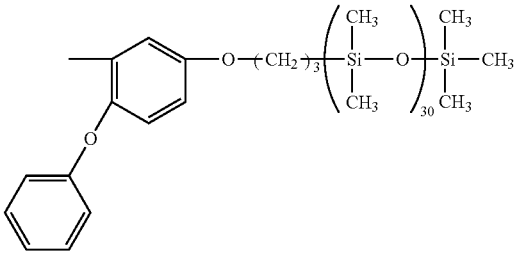

(D-8)

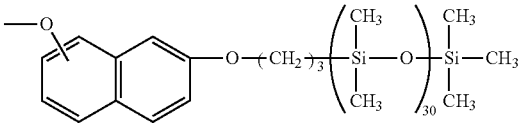

One type or two or more types of the polycarbonate resin D and the polyester resin E may be used as a homopolymer, a mixed polymer, or a copolymer. The form of the copolymer may be any one of a block copolymer, a random copolymer, and an alternating copolymer.

The siloxane moiety of the polycarbonate resin D and the polyester resin E means a structure in the dotted frame of an end structure represented by the following formula (D-S).

(D-S)

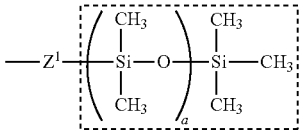

The content of the siloxane moiety relative to the total mass of the resin having the siloxane moiety may be analyzed by a general analytical method. An example of the analytical method is as follows.

Only the surface layer of an electrophotographic photosensitive member is dissolved in a solvent. Various substances contained in the surface layer are then fractionated with a fraction collector capable of isolating and collecting each constituent such as size exclusion chromatography and high performance liquid chromatography. The structure and content of a constituent substance in the fractionated resin having a siloxane moiety may be confirmed based on the peak positions of hydrogen atoms (hydrogen atoms constituting the resin) by $^{1}$H-NMR and a conversion method using the peak area ratio. The number of times the siloxane moiety is repeated and the molar ratio of the siloxane moiety are calculated from the results so as to be converted into the content (mass ratio). The siloxane-modified resin is hydrolyzed to a carboxylic acid portion and a bisphenol portion under the presence of an alkali. The produced bisphenol portion is analyzed by nuclear magnetic resonance spectrometry and mass spectrometry, and thereby the number of times the siloxane portion is repeated and the molar ratio of the siloxane portion are calculated to be converted to the content (mass ratio). In the present invention, the mass ratio of a siloxane moiety contained in the resin having a siloxane moiety was also measured by the method.

The content of a siloxane moiety in a resin having a siloxane moiety is preferably 1 mass % or more and 50 mass % or less relative to the total mass of the resin having a siloxane moiety.

A resin having a siloxane moiety has a weight average molecular weight of preferably 10,000 or more and 150,000 or less, more preferably 20,000 or more and 100,000 or less.

In the present invention, the weight average molecular weight of a resin means a polystyrene conversion weight average molecular weight measured by a method described in Japanese Patent Application Laid-Open No. 2007-79555 as usual.

In the present invention, the polycarbonate resin D and the polyester resin E may be synthesized by a known method such as a method described in Japanese Patent Application Laid-Open No. 2007-199688 and Japanese Patent Application Laid-Open No. 2010-126652. In the present invention, the synthesis examples of the polycarbonate resin D and the polyester resin E described in Table 1 were synthesized from raw materials corresponding to the polycarbonate resin D and the polyester resin E by the same synthesis method. In purification of the polycarbonate resin D and the polyester resin E, fractionation and isolation were performed by size exclusion chromatography. Each of the fractionated components was then measured by $^{1}$H-NMR, and the resin composition was determined from the relative ratio of the siloxane portion in the resin. The weight average molecular weight and the content of a siloxane moiety of the synthesized polycarbonate resin D and polyester resin E are described in Table 1.

The specific examples of the polycarbonate resin D and the polyester resin E are described below. The structural units (B-1) and (B-3) of the resins E(1), (2), (4) and (5) have a ratio of terephthalic acid skeleton to isophthalic acid skeleton of 5/5.

TABLE 1

| Polycarbonate resin D/Polyester resin E | Structural unit | End-siloxane moiety | Siloxane moiety content | Weight average molecular weight (Mw) |
|---|---|---|---|---|
| Resin D(1) | (A-6)/(A-7) = 8/2 | (D-1) | 4% | 41000 |
| Resin D(2) | (A-2)/(A-7) = 7/3 | (D-1) | 3% | 53000 |
| Resin D(3) | (A-4)/(A-7) = 7/3 | (D-1) | 4% | 47000 |
| Resin D(4) | (A-1)/(A-8) = 5/5 | (D-5) | 4% | 49000 |
| Resin D(5) | (A-6)/(A-7) = 8/2 | (D-1) | 23% | 38000 |
| Resin D(6) | (A-2)/(A-7) = 7/3 | (D-1) | 21% | 46000 |
| Resin D(7) | (A-4)/(A-7) = 7/3 | (D-1) | 20% | 43000 |
| Resin D(8) | (A-1)/(A-8) = 5/5 | (D-5) | 24% | 40000 |
| Resin E(1) | (B-1) | (D-1) | 3% | 53000 |
| Resin E(2) | (B-3) | (D-5) | 4% | 56000 |
| Resin E(3) | (B-8) | (D-5) | 4% | 50000 |
| Resin E(4) | (B-1) | (D-1) | 24% | 55000 |
| Resin E(5) | (B-3) | (D-5) | 20% | 49000 |
| Resin E(6) | (B-8) | (D-5) | 21% | 53000 |

In the view points of the reduction in initial friction coefficient and the prevention of a ghost image in repeated use, the content of component γ contained in the surface layer of an electrophotographic photosensitive member is preferably 1 mass % or more and 60 mass % or less relative to the total mass of the surface layer.

The structure of an electrophotographic photosensitive member is described below.

An electrophotographic photosensitive member of the present invention includes a support, a charge generating layer formed on the support, and a charge transporting layer formed on the charge generating layer, wherein the charge transporting layer is a surface layer. The charge generating layer may be formed of a laminated structure, or the charge transporting layer may be formed of a laminated structure. In the charge transporting layer formed of a laminated structure (FIG. 2B), at least the charge transporting layer to form the surface layer of an electrophotographic photosensitive member (a second charge transporting layer 104 in FIG. 2B) includes the component α, the component β and the component γ. In the charge transporting layer formed of one layer (FIG. 2A), the charge transporting layer to form the surface layer of an electrophotographic photosensitive member (charge transporting layer 103 in FIG. 2A) includes the component α, the component β and the component γ.

Figure 2A:
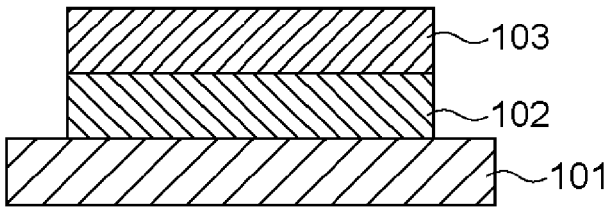
FIG. 2A illustrates an exemplary layer structure of an electrophotographic photosensitive member.
Figure 2B:
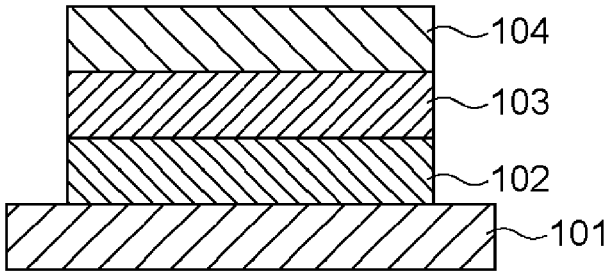
FIG. 2B illustrates another exemplary layer structure of an electrophotographic photosensitive member.

FIGS. 2A and 2B each illustrate an exemplary layer structure of an electrophotographic photosensitive member of the present invention. A support 101, a charge generating layer 102, a charge transporting layer 103, and a second charge transporting layer 104 are shown in FIGS. 2A and 2B.

[Support]

A support having conductivity (conductive support) is preferred, including a support made of metal or alloy such as aluminum, stainless steel, copper, nickel and zinc. In the case of a support made of aluminum or aluminum alloy, an ED tube, an EI tube, or a support made from the tube which is machined, electro chemical buffed, or wet or dry honed may be used. Alternatively, a thin film of a conductive material such as aluminum, aluminum alloy, or indium oxide-tin oxide alloy may be formed on a support made of metal or resin.

A support of resin or the like impregnated with conductive particles such as carbon black, tin oxide particles, titanium oxide particles, and silver particles, or a plastic having a conductive binder resin may be also used.

The surface of a support may be machined, roughened, or alumite-treated in order to reduce interference fringes due to scattering of laser light or the like.

An electrophotographic photosensitive member may have a support on which a conductive layer having conductive particles and a resin is formed. The conductive layer includes a coating film of a coating liquid for forming a conductive layer, formed of conductive particles dispersed in a binder resin.

Examples of the conductive particles include carbon black, acetylene black, powder of metal such as aluminum, nickel, iron, nichrome, copper, zinc and silver, and powder of metal oxide such as conductive tin oxide and ITO.

Examples of the binder resin for use in the conductive layer include a polyester resin, a polycarbonate resin, a polyvinyl butyral resin, an acrylic resin, a silicone resin, an epoxy resin, a melamine resin, an urethane resin, a phenol resin, and an alkyd resin.

Examples of the solvent for the coating liquid for forming a conductive layer include an ether solvent, an alcohol solvent, a ketone solvent, and an aromatic hydrocarbon solvent. The conductive layer can have a thickness of 0.2 μm or more and 40 μm or less, more preferably 1 μm or more and 35 μm or less, further more preferably 5 μm or more and 30 μm or less.

An undercoat layer may be arranged between a support or a conductive layer and a charge generating layer.

The undercoat layer can be formed by applying a coating liquid for forming an undercoat layer which contains a binder resin on the support or on the conductive layer to form a coating film, and by drying or curing the coating film.

Examples of the binder resin for use in the undercoat layer include polyacrylic acids, methyl cellulose, ethyl cellulose, a polyamide resin, a polyimide resin, a poly amide-imide resin, a polyamic acid resin, a melamine resin, an epoxy resin, and a polyurethane resin. A thermoplastic resin can be used as the binder resin in an undercoat layer. Specifically, a thermoplastic polyamide resin is preferred. Examples of the polyamide resin include a low-crystalline or non-crystalline copolymerized nylon applicable in a solution state.

Examples of the solvent for the coating liquid for forming an undercoat layer include an ether solvent, an alcohol solvent, a ketone solvent, and an aromatic hydrocarbon solvent. The undercoat layer can have a thickness of 0.05 μm or more and 40 μm or less, more preferably 0.1 μm or more and 30 μm or less. The undercoat layer may also contain semiconductor particles, an electron transporting substance, or an electron accepting substance.

[Charge Generating Layer]

A charge generating layer is arranged on a support, a conductive layer, or an undercoat layer.

Examples of the charge generating substance for use in the electrophotographic photosensitive member include an azo pigment, a phthalocyanine pigment, an indigo pigment and a perylene pigment. The charge generating substances may be used singly or in combinations of two or more types. Among them, oxytitanium phthalocyanine, hydroxygallium phthalocyanine, and chlorogallium phtalocyanine are preferred, having high sensitivity.

Examples of the binder resin used for the charge generating layer include a polycarbonate resin, a poly ester resin, a butyral resin, a polyvinyl acetal resin, an acrylic resin, a vinyl acetate resin and a urea formaldehyde resin. Among them, a butyral resin is particularly preferred. The resins can be used singly or in combinations of two or more types as a mixture or a copolymer.

The charge generating layer can be obtained by forming a coating film from a coating liquid for forming a charge generating layer which contains a dispersed charge generating substance with a binder resin and a solvent, and by drying the coating film. Alternatively, the charge generating layer may be a vapor-deposited film of charge generating substance.

Examples of the dispersion method include a method using a homogenizer, ultrasonic waves, a ball mill, a sand mill, an attritor, or a roll mill.

The ratio of a charge generating substance to a binder resin is preferably in the range of 0.1 mass parts or more and 10 mass parts or less of a charge generating substance relative to one mass part of a binder resin, more preferably 1 mass part or more and 3 mass parts or less.

Examples of the solvent for use in the coating liquid for forming a charge generating layer include an alcohol solvent, a sulfoxide solvent, a ketone solvent, an ether solvent, an ester solvent, and an aromatic hydrocarbon solvent.

The charge generating layer has a thickness of preferably 0.01 μm or more and 5 μm or less, more preferably 0.1 μm or more and 2 μm or less.

Various types of sensitizers, antioxidizing agents, ultraviolet absorbing agents, plasticizing agents, and the like may be added to the charge generating layer on an as needed basis. In order to prevent a charge (carrier) flow from stagnating in the charge generating layer, an electron transporting substance or an electron-accepting substance may be contained in the charge generating layer.

[Charge Transporting Layer]

An electrophotographic photosensitive member is provided with a charge transporting layer on the charge generating layer.

The charge transporting layer includes the component α as a charge transporting substance, and may further include another charge transporting substance. The charge transporting substances may be used singly or in combinations of two or more types.

The charge transporting layer can be obtained by forming a coating film from a coating liquid for forming a charge transporting layer which contains a charge transporting substance and a binder resin dissolved in a solvent, and by drying the coating film.

The charge transporting layer includes a binder resin which contains at least one type (component γ) from a polycarbonate resin having a siloxane moiety at the end and a polyester resin having a siloxane moiety at the end. The binder resin may further include another resin to be mixed. Example of the other resin includes a polycarbonate resin and a polyester resin. The polycarbonate resin includes a polycarbonate resin A having a structural unit represented by the formula (A) and no siloxane moiety at the end, and the polyester resin includes a polyester resin B having a structural unit represented by the formula (B) and no siloxane moiety at the end. Examples of the structural unit of the polycarbonate resin A include the (A-1) to (A-8). Among them, (A-1), (A-2) and (A-4) are preferred. Examples of the structural unit of the polyester resin B include the (B-1) to (B-9). Among them, (B-1), (B-2), (B-3), (B-6), (B-7) and (B-8) are preferred.

The polycarbonate resin A may be synthesized, for example, by a conventional phosgene method. Alternatively the polycarbonate resin A may be synthesized by transesterification. The polycarbonate resin A and the polyester resin B may be synthesized by known methods such as a method described in Japanese Patent Application Laid-Open No. 2007-047655 or Japanese Patent Application Laid-Open No. 2007-072277.

The polycarbonate resins A and the polyester resins B may be used singly or in combinations of two or more types as a mixture or a copolymer. The form of the copolymer may be any one of a block copolymer, a random copolymer, and an alternating copolymer.

The polycarbonate resin A and the polyester resin B have a weight average molecular weight of preferably 20,000 or more and 300,000 or less, more preferably 50,000 or more and 200,000 or less.

In the present invention, the weight average molecular weight of a resin means a polystyrene conversion weight average molecular weight measured by a method described in Japanese Patent Application Laid-Open No. 2007-79555 as usual.

The specific examples of the polycarbonate resin A and the polyester resin B having no siloxane moiety at the end are described below.

TABLE 2

| Polycarbonate resin A/Polyester resin B | Structural unit | Weight average molecular weight |
|---|---|---|
| Resin A(1) | (A-4) | 55,000 |
| Resin A(2) | (A-4) | 14,000 |
| Resin A(3) | (A-4) | 110,000 |
| Resin A(4) | (A-1) | 55,000 |
| Resin A(5) | (A-6) | 54,000 |
| Resin A(6) | (A-6)/(A-1) = 6.5/3.5 | 55,000 |
| Resin B(1) | (B-1) | 120,000 |
| Resin B(2) | (B-1)/(B-6) = 7/3 | 120,000 |
| Resin B(3) | (B-8) | 100,000 |

The charge transporting layer has a thickness of, preferably 5 to 50 μm, more preferably 10 to 30 μm. The mass ratio between the charge transporting substance and the binder resin is 5:1 to 1:5, preferably 3:1 to 1:3.

Examples of the solvent for use in the coating liquid for forming a charge transporting layer include an alcohol solvent, a sulfoxide solvent, a ketone solvent, an ether solvent, an ester solvent, and an aromatic hydrocarbon solvent. Xylene, toluene and tetrahydrofuran are preferred.

Various types of additives may be added to each layer of electrophotographic photosensitive member. Examples of the additive include a degradation preventing agent such as an antioxidant, a UV-ray absorbing agent and a weathering stabilizer, and fine particles such as organic fine particles and inorganic fine particles.

Examples of the degradation preventing agent include a hindered phenol antioxidant, hindered amine weathering stabilizer, a sulfur atom-containing antioxidant, and a phosphorus atom-containing antioxidant.

Examples of the organic fine particles include polymer resin particles such as fluorine atom-containing resin particles, polystyrene fine particles and polyethylene resin particles. Examples of the inorganic fine particles include metal oxide particles such as silica and alumina.

Examples of the application method of a coating liquid for forming each layer include immersion coating (dip coating), spray coating, spinner coating, roller coating, Meyer bar coating, and blade coating. Among them, immersion coating is preferred.

The drying temperature for drying the coating film of the coating liquid for forming each of the layers is preferably 60° C. or higher and 150° C. or lower. Among them, the drying temperature for drying the coating film of the coating liquid for forming a charge transporting layer as the surface layer of an electrophotographic photosensitive member is preferably 110° C. or higher and 140° C. or lower, in particular. The drying time is preferably 10 to 60 minutes, more preferably 20 to 60 minutes.

[Electrophotographic Apparatus]

FIG. 1 illustrates an exemplary schematic structure of an electrophotographic apparatus provided with a process cartridge having an electrophotographic photosensitive member of the present invention.

In FIG. 1, an electrophotographic photosensitive member 1 having a cylindrical shape is rotation driven around an axis 2 at a predetermined circumferential speed in an arrow direction. The surface of the rotation driven electrophotographic photosensitive member 1 is charged to a predetermined negative potential (negative charging) in a uniform state with a charging device 3 (primary charging device such as a charging roller) in a rotation process. Subsequently the surface is irradiated with exposing light beams (image exposing light beams) 4 intensity-modulated in response to the time-series electric digital image signals of objective image data output from an exposure device for slit exposure or laser beam scanning exposure (not shown). An electrostatic latent image corresponding to an objective image is thus sequentially formed on the surface of the electrophotographic photosensitive member 1.

The electrostatic latent image formed on the surface of the electrophotographic photosensitive member 1 is reversely developed with toner contained in the developer of a developing device 5 so as to form a toner image. The toner image formed and supported on the surface of the electrophotographic photosensitive member 1 is sequentially transferred to a transfer material (e.g. paper) P by a transfer bias from a transfer device 6 such as a transfer roller. The transfer material P is taken out from a transfer material feeding part (not shown) so as to be fed between the electrophotographic photosensitive member 1 and the transfer device 6 (contact part) in synchronization with the rotation of the electrophotographic photosensitive member 1. A bias voltage having a polarity reversal of the charge held on the toner is applied to the transfer device 6 from a bias power supply (not shown).

The transfer material P having a transferred toner image is separated from the surface of the electrophotographic photosensitive member 1 and brought in a fixation device 8 for the fixation of the toner image, so as to be transported outside the apparatus as an image formed object (print or copy).

After transfer of the toner image, the surface of the electrophotographic photosensitive member 1 is cleaned with a cleaning device 7 such as a cleaning blade for removing remaining developer after transfer (remaining toner after transfer). Subsequently the surface of the electrophotographic photosensitive member 1 is neutralized with pre-exposuring beams (not shown) from a pre-exposure device (not shown) and then repeatedly used for image formation. In the case as shown in FIG. 1, however, that the charging device 3 is a contact charging device having a charging roller or the like, pre-exposuring is not necessarily required.

A plurality of components selected from the group consisting of the electrophotographic photosensitive member 1, the charging device 3, the developing device 5, the transfer device 6, the cleaning device 7 and the like may be contained in a container and integrally supported to form a process cartridge. The process cartridge may be detachable to the body of an electrophotographic apparatus such as a copying machine and a laser beam printer. In FIG. 1, the charging device 3, the developing device 5, and the cleaning device 7 are integrally supported together with the electrophotographic photosensitive member 1 so as to form a cartridge. The cartridge constitutes a process cartridge 9 detachable to an electrophotographic apparatus body with a guiding device 10 such as a rail of the electrophotographic apparatus body.

EXAMPLES

The present invention is described further in detail in reference to specific Examples and Comparative Examples below, although the present invention is not limited thereto. In Examples, "parts" means "mass parts". The results in the following Examples 1 to 190, Comparative Examples 1 to 25, Reference Examples 1 to 3 are shown in Tables 3 to 15.

Example 1

An aluminum cylinder having a diameter of 30 mm and a length of 265 mm was prepared as a support (conductive support).

Subsequently, a coating liquid for forming a conductive layer was prepared from 10 parts of barium sulfate coated with $SnO_2$ (conductive particles), 2 parts of titanium oxide (pigment for adjusting resistance), 6 parts of phenol resin (binder resin), 0.001 parts of silicone oil (leveling agent), and a mixed solvent of 4 parts of methanol and 16 parts of methoxypropanol. The coating liquid for forming a conductive layer was applied to a support by immersion coating so as to form a coating film. The produced coating film was cured (thermally cured) at 140° C. for 30 minutes so as to form a conductive layer having a thickness of 15 μm.

Subsequently, a coating liquid for forming an undercoat layer was prepared by dissolving 3 parts of N-methoxymethylated nylon and 3 parts of copolymer nylon in a mixed solvent of 65 parts of methanol and 30 parts of n-butanol. The coating liquid for forming an undercoat layer was applied to the conductive layer by immersion coating so as to form a coating film. The produced coating film was dried at 80° C. for 10 minutes so as to form an undercoat layer having a thickness of 0.7 μm.

As a charge generating substance, 10 parts of the hydroxygallium phthalocyanine crystal (charge generating substance) with a crystalline form having strong peaks at Bragg angles 20±0.2° of 7.5°, 9.9°, 16.3°, 18.6°, 25.1° and 28.3° in characteristic X-ray diffraction with the CuKα radiation was prepared. This was added to a liquid of 250 parts of cyclohexanone dissolving 5 parts of a polyvinylbutyral resin (trade name: ESLEC BX-1, made by Sekisui Chemical Co., Ltd.). The liquid was put in a sand mill with glass beads having a diameter of 1 mm for dispersion treatment at 23±3° C. for 1 hour. To the dispersion liquid, 250 parts of ethyl acetate was added to prepare a coating liquid to form a charge generating layer. The coating liquid for forming a charge generating layer was applied to the undercoat layer by immersion coating so as to form a coating film. The produced coating film was dried at 100° C. for 10 minutes to form a charge generating layer having a thickness of 0.3 μm.

Subsequently, 9 parts of a compound (charge transporting substance) represented by the formula (1-3) as component α, 9.5 parts of polycarbonate resin A (1), 0.5 parts of polycarbonate resin D (1) as component γ, and 10 parts of methyl benzoate as component β were dissolved in 100 parts of tetrahydrofuran (THF), and thereby a coating liquid for forming a charge transporting layer was prepared. The coating liquid for forming a charge transporting layer was applied to the charge generating layer by immersion coating so as to form a coating film. The produced coating film was dried at 125° C. for 40 minutes to form a charge transporting layer having a thickness of 16 μm. The electrophotographic photosensitive member having a conductive layer, an undercoat layer, a charge generating layer, and a charge transporting layer (surface layer) was thus manufactured.

It was confirmed that the produced charge transporting layer (surface layer) contained 0.12 mass % methyl benzoate relative to the total mass of the surface layer by the above-mentioned measurement method using gas chromatography.

The evaluation is described below.

The positive memory reduction ratio and the initial friction coefficient were evaluated.

<Evaluation of Positive Memory Reduction Ratio>

A laser beam printer LASER JET 4250 made by Hewlett Packard Company was used as an evaluation apparatus for evaluating the positive memory reduction ratio. An electrophotographic photosensitive member modified from the process cartridge of the LASER JET 4250 was mounted for evaluation by the following method. The evaluation was performed in an environment with a temperature of 15° C. and a humidity of 10% RH. In a state that the process cartridge installed in the evaluation apparatus was uncharged and unexposed, the electrophotographic photosensitive member was charged with positive electric charges to reach plus 50 V (amount of positive charge) with a transfer roller. The evaluation apparatus and the process cartridge were left standing for 1 minute. The amount of reduction in positive charge (positive memory) thereafter was measured for the measurement of the positive memory reduction ratio. The positive memory reduction ratio was obtained from the following equation. The results are shown in Tables 11 to 13. The higher the positive memory reduction rate, the more excellent effect was achieved on the positive memory reduction.

Positive memory reduction ratio (%)=(amount of reduction in positive memory)/(amount of positive charge)×100%

<Image Evaluation on Positive Memory>

The electrophotographic photosensitive member modified from the process cartridge of the evaluation apparatus LASER JET 4250 was mounted for evaluation by the following vibration test. In the modification, the spring pressure of the charging member was changed to 1.5 times.

A vibration test was performed according to a physical distribution test standard JIS Z 0230 in an environment with a temperature of 15° C. and a humidity of 10% RH. A process cartridge was placed in a vibration testing apparatus (EMIC CORP. Model 905-FN). Subsequently, a vibration test was performed with the vibration testing apparatus at a frequency of 10 Hz to 100 Hz and an acceleration of 1 G in each direction of x, y and z axes, with an LIN sweep direction for a reciprocal sweeping time of 5 minutes, for a testing time of 1 hour. After leaving standing for 2 hours, half tone images were output with the evaluation apparatus for evaluation. The image evaluation standard is as follows. The results are shown in Tables 11 to 13.

A: No lateral black stripe caused by positive memory is observed in an image.

B: One lateral black stripe caused by positive memory is observed in an image.

C: Two lateral black stripes caused by positive memory are observed in an image.

D: Three or more lateral black stripes caused by positive memory are observed in an image.

<Measurement of Friction Coefficient>

The friction coefficient of the produced electrophotographic photosensitive member was measured by the following method. The measurement of the friction coefficient was performed in an environment with normal temperature and normal humidity (23° C. and 50% RH) with a HEIDON-14 made by Shinto Scientific Co., Ltd. A blade (urethane rubber blade) under a predetermined load was arranged in contact with the electrophotographic photosensitive member. When the electrophotographic photosensitive member was moved in parallel with the axial direction of the electrophotographic photosensitive member at a scanning speed of 50 mm/min, the friction force applied between the electrophotographic photosensitive member and the rubber blade was measured. The friction force was measured as the amount of strain of a strain gauge attached to the urethane rubber side, which was then converted into a tensile load (force applied to the electrophotographic photosensitive member). The kinetic friction coefficient was obtained from [force (friction force) applied to the electrophotographic photosensitive member (gf)]/[load applied to the blade (gf)] during the movement of the urethane rubber blade. The urethane rubber blade for use was prepared by cutting a urethane blade made by Hokushin Kogyo KK (rubber hardness: 67°) into a 5 mm by 30 mm by 2 mm piece. The measurement was performed under a load of 50 g at an angle of 27° in the width direction. In Example 1, the friction coefficient was 0.18. The results are shown in Tables 11 to 13.

Examples 2 to 44 and 47 to 190

Except that the types of the component α, the component β, the component γ, the polycarbonate resin A, the polyester resin B, and the solvent of the charge transporting layer in Example 1 were changed as shown in Table 3, an electrophotographic photosensitive member was manufactured in the same way as in Example 1.

Examples 191 to 194

Except that the types of the component α, the component β, the component γ, the polycarbonate resin A, the polyester resin B, and the solvent of the charge transporting layer in Example 1 were changed as shown in Table 3, an electrophotographic photosensitive member was manufactured in the same way as in Example 1.

Example 45

Except that the drying temperature of the charge transporting layer in Example 1 was changed to 135° C., an electrophotographic photosensitive member was manufactured in the same way as in Example 1.

Example 46

Except that the drying temperature of the charge transporting layer in Example 1 was changed to 110° C., an electrophotographic photosensitive member was manufactured in the same way as in Example 1.

TABLE 3

| | Polycarbonate/Polyester resin | | | | | | | | | |
|---|---|---|---|---|---|---|---|---|---|---|
| | Resin A/Resin B | | Resin D/Resin | | Component α | | Component β | | Solvent | |
| Example | Resin type | Part | Resin type | Part | Type | Part | Type | Part | Type | Parts |
| 1 | Resin A | 9.5 | Resin D | 0.5 | (1- | 9 | Methyl benzoate | 10 | THF | 100 |
| 2 | Resin A | 9.5 | Resin D | 0.5 | (1- | 9 | Methyl benzoate | 2 | THF | 100 |
| 3 | Resin A | 9.5 | Resin D | 0.5 | (1- | 9 | Methyl benzoate | 15 | THF | 100 |
| 4 | Resin A | 9.5 | Resin D | 0.5 | (1- | 9 | Cyclohexanol | 10 | THF | 100 |
| 5 | Resin A | 9.5 | Resin D | 0.5 | (1- | 9 | Benzyl alcohol | 10 | THF | 100 |
| 6 | Resin A | 9.5 | Resin D | 0.5 | (1- | 9 | Ethyl benzoate | 10 | THF | 100 |
| 7 | Resin A | 9.5 | Resin D | 0.5 | (1- | 9 | Benzyl acetate | 10 | THF | 100 |
| 8 | Resin A (1) | 9.5 | Resin D (1) | 0.5 | (1-3) | 9 | Ethyl 3-ethoxypropionate | 10 | THF | 100 |
| 9 | Resin A | 9.5 | Resin D | 0.5 | (1- | 9 | Acetophenone | 10 | THF | 100 |
| 10 | Resin A | 9.5 | Resin D | 0.5 | (1- | 9 | Methyl salicylate | 10 | THF | 100 |
| 11 | Resin A | 9.5 | Resin D | 0.5 | (1- | 9 | Dimethyl phthalate | 10 | THF | 100 |
| 12 | Resin A | 9.5 | Resin D | 0.5 | (1- | 9 | Hexanol | 10 | THF | 100 |
| 13 | Resin A | 9.5 | Resin D | 0.5 | (1- | 9 | Heptanol | 10 | THF | 100 |
| 14 | Resin A | 9.5 | Resin D | 0.5 | (1- | 9 | Ethylene glycol | 10 | THF | 100 |
| 15 | Resin A | 9.5 | Resin D | 0.5 | (1- | 9 | 1,4-Butanediol | 10 | THF | 100 |
| 16 | Resin A | 9.5 | Resin D | 0.5 | (1- | 9 | 1,5-Pentanediol | 10 | THF | 100 |
| 17 | Resin A | 9.5 | Resin D | 0.5 | (1- | 9 | Diethylene glycol | 10 | THF | 100 |
| 18 | Resin A (1) | 9.5 | Resin D (1) | 0.5 | (1-3) | 9 | Diethylene glycol ethyl methyl ether | 10 | THF | 100 |
| 19 | Resin A | 9.5 | Resin D | 0.5 | (1- | 9 | Ethylene carbonate | 10 | THF | 100 |
| 20 | Resin A | 9.5 | Resin D | 0.5 | (1- | 9 | Propylene | 10 | THF | 100 |
| 21 | Resin A | 9.5 | Resin D | 0.5 | (1- | 9 | Nitrobenzene | 10 | THF | 100 |
| 22 | Resin A | 9.5 | Resin D | 0.5 | (1- | 9 | Pyrrolidone | 10 | THF | 100 |
| 23 | Resin A | 9.5 | Resin D | 0.5 | (1- | 9 | N— | 10 | THF | 100 |
| 24 | Resin A | 9.5 | Resin D | 0.5 | (1- | 9 | Sulfolane | 10 | THF | 100 |
| 25 | Resin A (1) | 9.5 | Resin D (1) | 0.5 | (1-3) | 9 | Methyl benzoate | 10 | THF/Toluene | 80/20 |
| 26 | — | — | Resin D | 10 | (1- | 9 | Methyl benzoate | 10 | THF | 100 |
| 27 | Resin A | 9.5 | Resin D | 0.5 | (1- | 9 | Methyl benzoate | 10 | THF | 100 |
| 28 | Resin A | 9.5 | Resin D | 0.5 | (1- | 9 | Methyl benzoate | 10 | THF | 100 |
| 29 | Resin B | 9.5 | Resin D | 0.5 | (1- | 9 | Methyl benzoate | 10 | THF | 100 |
| 30 | Resin A | 9.5 | Resin D | 0.5 | (1- | 9 | Methyl benzoate | 10 | THF | 100 |
| 31 | Resin A | 9.5 | Resin D | 0.5 | (1- | 9 | Methyl benzoate | 10 | THF | 100 |
| 32 | Resin A | 9.5 | Resin D | 0.5 | (1- | 9 | Methyl benzoate | 10 | THF | 100 |
| 33 | Resin A | 9.5 | Resin D | 0.5 | (1- | 9 | Benzyl acetate | 10 | THF | 100 |
| 34 | Resin A (1) | 9.5 | Resin D (1) | 0.5 | (1-1) | 9 | Ethyl 3-ethoxypropionate | 10 | THF | 100 |
| 35 | Resin A (1) | 9.5 | Resin D (1) | 0.5 | (1-1) | 9 | Diethylene glycol ethyl methyl ether | 10 | THF | 100 |
| 36 | Resin A | 9.5 | Resin D | 0.5 | (1- | 9 | Cyclohexanol | 10 | THF | 100 |
| 37 | Resin A | 9.5 | Resin D | 0.5 | (1- | 9 | Benzyl alcohol | 10 | THF | 100 |
| 38 | Resin A | 9.5 | Resin D | 0.5 | (1- | 9 | Methyl benzoate | 10 | THF | 100 |
| 39 | Resin A | 9.5 | Resin D | 0.5 | (1- | 9 | Ethyl benzoate | 10 | THF | 100 |
| 40 | Resin A | 9.5 | Resin D | 0.5 | (1- | 9 | Benzyl acetate | 10 | THF | 100 |
| 41 | Resin A (1) | 9.5 | Resin D (1) | 0.5 | (1-8) | 9 | Ethyl 3-ethoxypropionate | 10 | THF | 100 |
| 42 | Resin A | 9.5 | Resin D | 0.5 | (1- | 9 | Acetophenone | 10 | THF | 100 |
| 43 | Resin A | 9.5 | Resin D | 0.5 | (1- | 9 | Methyl salicylate | 10 | THF | 100 |
| 44 | Resin A | 9.5 | Resin D | 0.5 | (1- | 9 | Dimethyl phthalate | 10 | THF | 100 |
| 45 | Resin A | 9.5 | Resin D | 0.5 | (1- | 9 | Methyl benzoate | 10 | THF | 100 |
| 46 | Resin A | 9.5 | Resin D | 0.5 | (1- | 9 | Methyl benzoate | 10 | THF | 100 |

TABLE 4

| | Polycarbonate/Polyester resin | | | | | | | | | |
|---|---|---|---|---|---|---|---|---|---|---|
| | Resin A/Resin | | Resin D/Resin E | | Component α | | Component (β) | | Solvent | |
| Example | Resin type | Part | Resin type | Parts | Type | Parts | Type | Parts | Type | Parts |
| 47 | Resin A | 9.5 | Resin D | 0.5 | (2-1) | 9 | Methyl benzoate | 10 | THF | 100 |
| 48 | Resin A | 9.5 | Resin D | 0.5 | (2-1) | 9 | Methyl benzoate | 2 | THF | 100 |
| 49 | Resin A | 9.5 | Resin D | 0.5 | (2-1) | 9 | Methyl benzoate | 15 | THF | 100 |
| 50 | Resin A | 9.5 | Resin D | 0.5 | (2-1) | 9 | Cyclohexanol | 10 | THF | 100 |
| 51 | Resin A | 9.5 | Resin D | 0.5 | (2-1) | 9 | Benzyl alcohol | 10 | THF | 100 |
| 52 | Resin A | 9.5 | Resin D | 0.5 | (2-1) | 9 | Ethyl benzoate | 10 | THF | 100 |
| 53 | Resin A | 9.5 | Resin D | 0.5 | (2-1) | 9 | Benzyl acetate | 10 | THF | 100 |
| 54 | Resin A (1) | 9.5 | Resin D (1) | 0.5 | (2-1) | 9 | Ethyl 3-ethoxypropionate | 10 | THF | 100 |
| 55 | Resin A | 9.5 | Resin D | 0.5 | (2-1) | 9 | Acetophenone | 10 | THF | 100 |
| 56 | Resin A | 9.5 | Resin D | 0.5 | (2-1) | 9 | Methyl salicylate | 10 | THF | 100 |

TABLE 4-continued

| | Polycarbonate/Polyester resin | | | | | | | | Solvent | |
|---|---|---|---|---|---|---|---|---|---|---|
| | Resin A/Resin | | Resin D/Resin E | | Component α | | Component (β) | | | |
| Example | Resin type | Part | Resin type | Parts | Type | Parts | Type | Parts | Type | Parts |
| 57 | Resin A | 9.5 | Resin D | 0.5 | (2-1) | 9 | Dimethyl phthalate | 10 | THF | 100 |
| 58 | Resin A | 9.5 | Resin D | 0.5 | (2-1) | 9 | Hexanol | 10 | THF | 100 |
| 59 | Resin A | 9.5 | Resin D | 0.5 | (2-1) | 9 | Heptanol | 10 | THF | 100 |
| 60 | Resin A | 9.5 | Resin D | 0.5 | (2-1) | 9 | Ethylene glycol | 10 | THF | 100 |
| 61 | Resin A | 9.5 | Resin D | 0.5 | (2-1) | 9 | 1,4-Butanediol | 10 | THF | 100 |
| 62 | Resin A | 9.5 | Resin D | 0.5 | (2-1) | 9 | 1,5-Pentanediol | 10 | THF | 100 |
| 63 | Resin A | 9.5 | Resin D | 0.5 | (2-1) | 9 | Diethylene glycol | 10 | THF | 100 |
| 64 | Resin A (1) | 9.5 | Resin D (1) | 0.5 | (2-1) | 9 | Diethylene glycol ethyl methyl ether | 10 | THF | 100 |
| 65 | Resin A | 9.5 | Resin D | 0.5 | (2-1) | 9 | Ethylene carbonate | 10 | THF | 100 |
| 66 | Resin A | 9.5 | Resin D | 0.5 | (2-1) | 9 | Propylene | 10 | THF | 100 |
| 67 | Resin A | 9.5 | Resin D | 0.5 | (2-1) | 9 | Nitrobenzene | 10 | THF | 100 |
| 68 | Resin A | 9.5 | Resin D | 0.5 | (2-1) | 9 | Pyrrolidone | 10 | THF | 100 |
| 69 | Resin A | 9.5 | Resin D | 0.5 | (2-1) | 9 | N— | 10 | THF | 100 |
| 70 | Resin A | 9.5 | Resin D | 0.5 | (2-1) | 9 | Sulfolane | 10 | THF | 100 |
| 71 | Resin A (1) | 9.5 | Resin D (1) | 0.5 | (2-1) | 9 | Methyl benzoate | 10 | THF/Toluene | 80/20 |
| 72 | — | — | Resin D | 10 | (2-1) | 9 | Methyl benzoate | 10 | THF | 100 |
| 73 | Resin A | 9.5 | Resin D | 0.5 | (2-1) | 9 | Methyl benzoate | 10 | THF | 100 |
| 74 | Resin A | 9.5 | Resin D | 0.5 | (2-1) | 9 | Methyl benzoate | 10 | THF | 100 |
| 75 | Resin B | 9.5 | Resin D | 0.5 | (2-1) | 9 | Methyl benzoate | 10 | THF | 100 |
| 76 | Resin A | 9.5 | Resin D | 0.5 | (2-1) | 9 | Methyl benzoate | 10 | THF | 100 |
| 77 | Resin A | 9.5 | Resin D | 0.5 | (2-1) | 9 | Methyl benzoate | 10 | THF | 100 |
| 78 | Resin A | 9.5 | Resin D | 0.5 | (2-2) | 9 | Methyl benzoate | 10 | THF | 100 |
| 79 | Resin A | 9.5 | Resin D | 0.5 | (2-2) | 9 | Benzyl acetate | 10 | THF | 100 |
| 80 | Resin A (1) | 9.5 | Resin D (1) | 0.5 | (2-2) | 9 | Ethyl 3-ethoxypropionate | 10 | THF | 100 |
| 81 | Resin A (1) | 9.5 | Resin D (1) | 0.5 | (2-2) | 9 | Diethylene glycol ethyl methyl ether | 10 | THF | 100 |
| 82 | Resin A | 9.5 | Resin D | 0.5 | (2-4) | 9 | Methyl benzoate | 10 | THF | 100 |
| 83 | Resin A | 9.5 | Resin D | 0.5 | (2-4) | 9 | Benzyl acetate | 10 | THF | 100 |
| 84 | Resin A (1) | 9.5 | Resin D (1) | 0.5 | (2-4) | 9 | Ethyl 3-ethoxypropionate | 10 | THF | 100 |
| 85 | Resin A (1) | 9.5 | Resin D (1) | 0.5 | (2-4) | 9 | Diethylene glycol ethyl methyl ether | 10 | THF | 100 |

TABLE 5

| | Polycarbonate/Polyester resin | | | | | | | | Solvent | |
|---|---|---|---|---|---|---|---|---|---|---|
| | Resin A/Resin B | | Resin D/Resin E | | Component α | | Component β | | | Mass |
| Example | Resin type | Parts | Resin type | Parts | Type | Parts | Type | Parts | Type | parts |
| 86 | Resin B | 9.5 | Resin E | 0.5 | (3-1) | 5 | Methyl benzoate | 10 | THF | 100 |
| 87 | Resin B | 9.5 | Resin E | 0.5 | (3-1) | 5 | Methyl benzoate | 2 | THF | 100 |
| 88 | Resin B | 9.5 | Resin E | 0.5 | (3-1) | 5 | Methyl benzoate | 15 | THF | 100 |
| 89 | Resin B | 9.5 | Resin E | 0.5 | (3-1) | 5 | Cyclohexanol | 10 | THF | 100 |
| 90 | Resin B | 9.5 | Resin E | 0.5 | (3-1) | 5 | Benzyl alcohol | 10 | THF | 100 |
| 91 | Resin B | 9.5 | Resin E | 0.5 | (3-1) | 5 | Ethyl benzoate | 10 | THF | 100 |
| 92 | Resin B | 9.5 | Resin E | 0.5 | (3-1) | 5 | Benzyl acetate | 10 | THF | 100 |
| 93 | Resin B (3) | 9.5 | Resin E (3) | 0.5 | (3-1) | 5 | Ethyl 3-ethoxypropionate | 10 | THF | 100 |
| 94 | Resin B | 9.5 | Resin E | 0.5 | (3-1) | 5 | Acetophenone | 10 | THF | 100 |
| 95 | Resin B | 9.5 | Resin E | 0.5 | (3-1) | 5 | Methyl salicylate | 10 | THF | 100 |
| 96 | Resin B | 9.5 | Resin E | 0.5 | (3-1) | 5 | Dimethyl phthalate | 10 | THF | 100 |
| 97 | Resin B | 9.5 | Resin E | 0.5 | (3-1) | 5 | Hexanol | 10 | THF | 100 |
| 98 | Resin B | 9.5 | Resin E | 0.5 | (3-1) | 5 | Heptanol | 10 | THF | 100 |
| 99 | Resin B | 9.5 | Resin E | 0.5 | (3-1) | 5 | Ethylene glycol | 10 | THF | 100 |
| 100 | Resin B | 9.5 | Resin E | 0.5 | (3-1) | 5 | 1,4-Butanediol | 10 | THF | 100 |
| 101 | Resin B | 9.5 | Resin E | 0.5 | (3-1) | 5 | 1,5-Pentanediol | 10 | THF | 100 |
| 102 | Resin B | 9.5 | Resin E | 0.5 | (3-1) | 5 | Diethylene glycol | 10 | THF | 100 |
| 103 | Resin B (3) | 9.5 | Resin E (3) | 0.5 | (3-1) | 5 | Diethylene glycol ethyl methyl ether | 10 | THF | 100 |
| 104 | Resin B | 9.5 | Resin E | 0.5 | (3-1) | 5 | Ethylene carbonate | 10 | THF | 100 |
| 105 | Resin B | 9.5 | Resin E | 0.5 | (3-1) | 5 | Propylene | 10 | THF | 100 |
| 106 | Resin B | 9.5 | Resin E | 0.5 | (3-1) | 5 | Nitrobenzene | 10 | THF | 100 |
| 107 | Resin B | 9.5 | Resin E | 0.5 | (3-1) | 5 | Pyrrolidone | 10 | THF | 100 |
| 108 | Resin B | 9.5 | Resin E | 0.5 | (3-1) | 5 | N— | 10 | THF | 100 |
| 109 | Resin B | 9.5 | Resin E | 0.5 | (3-1) | 5 | Sulfolane | 10 | THF | 100 |
| 110 | Resin B (3) | 9.5 | Resin E (3) | 0.5 | (3-1) | 5 | Methyl benzoate | 10 | THF/Toluene | 80/20 |
| 111 | — | — | Resin E | 10 | (3-1) | 5 | Methyl benzoate | 10 | THF | 100 |

TABLE 5-continued

| | Polycarbonate/Polyester resin | | | | | | | | Solvent | |
|---|---|---|---|---|---|---|---|---|---|---|
| | Resin A/Resin B | | Resin D/Resin E | | Component α | | Component β | | | Mass |
| Example | Resin type | Parts | Resin type | Parts | Type | Parts | Type | Parts | Type | parts |
| 112 | Resin A | 9.5 | Resin E | 0.5 | (3-1) | 5 | Methyl benzoate | 10 | THF | 100 |
| 113 | Resin A | 9.5 | Resin E | 0.5 | (3-1) | 5 | Methyl benzoate | 10 | THF | 100 |
| 114 | Resin A | 9.5 | Resin E | 0.5 | (3-1) | 5 | Methyl benzoate | 10 | THF | 100 |
| 115 | Resin B | 9.5 | Resin E | 0.5 | (3-1) | 5 | Methyl benzoate | 10 | THF | 100 |
| 116 | Resin B | 9.5 | Resin D | 0.5 | (3-1) | 5 | Methyl benzoate | 10 | THF | 100 |
| 117 | Resin B | 9.5 | Resin E | 0.5 | (3-2) | 5 | Methyl benzoate | 10 | THF | 100 |
| 118 | Resin B | 9.5 | Resin E | 0.5 | (3-2) | 5 | Benzyl acetate | 10 | THF | 100 |
| 119 | Resin B (3) | 9.5 | Resin E (3) | 0.5 | (3-2) | 5 | Ethyl 3-ethoxypropionate | 10 | THF | 100 |
| 120 | Resin B (3) | 9.5 | Resin E (3) | 0.5 | (3-2) | 5 | Diethylene glycol ethyl methyl ether | 10 | THF | 100 |

TABLE 6

| | Polycarbonate/Polyester resin | | | | | | | | | |
|---|---|---|---|---|---|---|---|---|---|---|
| | Resin A/Resin B | | Resin D/Resin | | Component α | | Component β | | Solvent | |
| Example | Resin type | Parts | Resin type | Part | Type | Part | Type | Parts | Type | Parts |
| 121 | Resin B | 9.5 | Resin E | 0.5 | (4-2) | 5 | Methyl benzoate | 10 | THF | 100 |
| 122 | Resin B | 9.5 | Resin E | 0.5 | (4-2) | 5 | Methyl benzoate | 2 | THF | 100 |
| 123 | Resin B | 9.5 | Resin E | 0.5 | (4-2) | 5 | Methyl benzoate | 15 | THF | 100 |
| 124 | Resin B | 9.5 | Resin E | 0.5 | (4-2) | 5 | Cyclohexanol | 10 | THF | 100 |
| 125 | Resin B | 9.5 | Resin E | 0.5 | (4-2) | 5 | Benzyl alcohol | 10 | THF | 100 |
| 126 | Resin B | 9.5 | Resin E | 0.5 | (4-2) | 5 | Ethyl benzoate | 10 | THF | 100 |
| 127 | Resin B | 9.5 | Resin E | 0.5 | (4-2) | 5 | Benzyl acetate | 10 | THF | 100 |
| 128 | Resin B (3) | 9.5 | Resin E (3) | 0.5 | (4-2) | 5 | Ethyl 3-ethoxypropionate | 10 | THF | 100 |
| 129 | Resin B | 9.5 | Resin E | 0.5 | (4-2) | 5 | Acetophenone | 10 | THF | 100 |
| 130 | Resin B | 9.5 | Resin E | 0.5 | (4-2) | 5 | Methyl salicylate | 10 | THF | 100 |
| 131 | Resin B | 9.5 | Resin E | 0.5 | (4-2) | 5 | Dimethyl phthalate | 10 | THF | 100 |
| 132 | Resin B | 9.5 | Resin E | 0.5 | (4-2) | 5 | Hexanol | 10 | THF | 100 |
| 133 | Resin B | 9.5 | Resin E | 0.5 | (4-2) | 5 | Heptanol | 10 | THF | 100 |
| 134 | Resin B | 9.5 | Resin E | 0.5 | (4-2) | 5 | Ethylene glycol | 10 | THF | 100 |
| 135 | Resin B | 9.5 | Resin E | 0.5 | (4-2) | 5 | 1,4-Butanediol | 10 | THF | 100 |
| 136 | Resin B | 9.5 | Resin E | 0.5 | (4-2) | 5 | 1,5-Pentanediol | 10 | THF | 100 |
| 137 | Resin B | 9.5 | Resin E | 0.5 | (4-2) | 5 | Diethylene glycol | 10 | THF | 100 |
| 138 | Resin B (3) | 9.5 | Resin E (3) | 0.5 | (4-2) | 5 | Diethylene glycolethyl methyl | 10 | THF | 100 |
| 139 | Resin B | 9.5 | Resin E | 0.5 | (4-2) | 5 | Ethylene carbonate | 10 | THF | 100 |
| 140 | Resin B | 9.5 | Resin E | 0.5 | (4-2) | 5 | Propylene | 10 | THF | 100 |
| 141 | Resin B | 9.5 | Resin E | 0.5 | (4-2) | 5 | Nitrobenzene | 10 | THF | 100 |
| 142 | Resin B | 9.5 | Resin E | 0.5 | (4-2) | 5 | Pyrrolidone | 10 | THF | 100 |
| 143 | Resin B | 9.5 | Resin E | 0.5 | (4-2) | 5 | N— | 10 | THF | 100 |
| 144 | Resin B | 9.5 | Resin E | 0.5 | (4-2) | 5 | Sulfolane | 10 | THF | 100 |
| 145 | Resin B (3) | 9.5 | Resin E (3) | 0.5 | (4-2) | 5 | Methyl benzoate | 10 | THF/Toluene | 80/20 |
| 146 | — | — | Resin E | 10 | (4-2) | 5 | Methyl benzoate | 10 | THF | 100 |
| 147 | Resin A | 9.5 | Resin E | 0.5 | (4-2) | 5 | Methyl benzoate | 10 | THF | 100 |
| 148 | Resin A | 9.5 | Resin E | 0.5 | (4-2) | 5 | Methyl benzoate | 10 | THF | 100 |
| 149 | Resin A | 9.5 | Resin E | 0.5 | (4-2) | 5 | Methyl benzoate | 10 | THF | 100 |
| 150 | Resin B | 9.5 | Resin E | 0.5 | (4-2) | 5 | Methyl benzoate | 10 | THF | 100 |
| 151 | Resin B | 9.5 | Resin E | 0.5 | (4-2) | 5 | Methyl benzoate | 10 | THF | 100 |
| 152 | Resin B | 9.5 | Resin D | 0.5 | (4-1) | 5 | Methyl benzoate | 10 | THF | 100 |
| 153 | Resin B | 9.5 | Resin E | 0.5 | (4-1) | 5 | Benzyl acetate | 10 | THF | 100 |
| 154 | Resin B (3) | 9.5 | Resin E (3) | 0.5 | (4-1) | 5 | Ethyl 3-ethoxypropionate | 10 | THF | 100 |
| 155 | Resin B (3) | 9.5 | Resin E (3) | 0.5 | (4-1) | 5 | Diethylene glycol ethyl methyl ether | 10 | THF | 100 |

TABLE 7

| | Polycarbonate/Polyester resin | | | | | | | | Solvent | |
|---|---|---|---|---|---|---|---|---|---|---|
| | Resin A/Resin B | | Resin D/Resin E | | Component α | | Component β | | | Mass |
| | Resin type | Parts | Resin type | Parts | Type | Parts | Type | Parts | Type | parts |
| 156 | Resin A (1) | 9.5 | Resin E (3) | 0.5 | (5-2) | 9 | Methyl benzoate | 10 | THF | 100 |
| 157 | Resin A (1) | 9.5 | Resin E (3) | 0.5 | (5-2) | 9 | Methyl benzoate | 2 | THF | 100 |
| 158 | Resin A (1) | 9.5 | Resin E (3) | 0.5 | (5-2) | 9 | Methyl benzoate | 15 | THF | 100 |
| 159 | Resin A (1) | 9.5 | Resin E (3) | 0.5 | (5-2) | 9 | Cyclohexanol | 10 | THF | 100 |
| 160 | Resin A (1) | 9.5 | Resin E (3) | 0.5 | (5-2) | 9 | Benzyl alcohol | 10 | THF | 100 |
| 161 | Resin A (1) | 9.5 | Resin E (3) | 0.5 | (5-2) | 9 | Ethyl benzoate | 10 | THF | 100 |
| 162 | Resin A (1) | 9.5 | Resin E (3) | 0.5 | (5-2) | 9 | Benzyl acetate | 10 | THF | 100 |
| 163 | Resin A (1) | 9.5 | Resin E (3) | 0.5 | (5-2) | 9 | Ethyl 3-ethoxypropionate | 10 | THF | 100 |
| 164 | Resin A (1) | 9.5 | Resin E (3) | 0.5 | (5-2) | 9 | Acetophenone | 10 | THF | 100 |
| 165 | Resin A (1) | 9.5 | Resin E (3) | 0.5 | (5-2) | 9 | Methyl salicylate | 10 | THF | 100 |
| 166 | Resin A (1) | 9.5 | Resin E (3) | 0.5 | (5-2) | 9 | Dimethyl phthalate | 10 | THF | 100 |
| 167 | Resin A (1) | 9.5 | Resin E (3) | 0.5 | (5-2) | 9 | Hexanol | 10 | THF | 100 |
| 168 | Resin A (1) | 9.5 | Resin E (3) | 0.5 | (5-2) | 9 | Heptanol | 10 | THF | 100 |
| 169 | Resin A (1) | 9.5 | Resin E (3) | 0.5 | (5-2) | 9 | Ethylene glycol | 10 | THF | 100 |
| 170 | Resin A (1) | 9.5 | Resin E (3) | 0.5 | (5-2) | 9 | 1,4-Butanediol | 10 | THF | 100 |
| 171 | Resin A (1) | 9.5 | Resin E (3) | 0.5 | (5-2) | 9 | 1.5-Pentanediol | 10 | THF | 100 |
| 172 | Resin A (1) | 9.5 | Resin E (3) | 0.5 | (5-2) | 9 | Diethylene glycol | 10 | THF | 100 |
| 173 | Resin A (1) | 9.5 | Resin E (3) | 0.5 | (5-2) | 9 | Diethylene glycol ethyl methyl ether | 10 | THF | 100 |
| 174 | Resin A (1) | 9.5 | Resin E (3) | 0.5 | (5-2) | 9 | Ethylene carbonate | 10 | THF | 100 |
| 175 | Resin A (1) | 9.5 | Resin E (3) | 0.5 | (5-2) | 9 | Propylene | 10 | THF | 100 |
| 176 | Resin A (1) | 9.5 | Resin E (3) | 0.5 | (5-2) | 9 | Nitrobenzene | 10 | THF | 100 |
| 177 | Resin A (1) | 9.5 | Resin E (3) | 0.5 | (5-2) | 9 | Pyrrolidone | 10 | THF | 100 |
| 178 | Resin A (1) | 9.5 | Resin E (3) | 0.5 | (5-2) | 9 | N— | 10 | THF | 100 |
| 179 | Resin A (1) | 9.5 | Resin E (3) | 0.5 | (5-2) | 9 | Sulfolane | 10 | THF | 100 |
| 180 | Resin A (1) | 9.5 | Resin E (3) | 0.5 | (5-2) | 9 | Methyl benzoate | 10 | THF/Toluene | 80/20 |
| 181 | — | — | Resin E (3) | 10 | (5-2) | 9 | Methyl benzoate | 10 | THF | 100 |
| 182 | Resin A (4) | 9.5 | Resin E (3) | 0.5 | (5-2) | 9 | Methyl benzoate | 10 | THF | 100 |
| 183 | Resin A (5) | 9.5 | Resin E (3) | 0.5 | (5-2) | 9 | Methyl benzoate | 10 | THF | 100 |
| 184 | Resin B (3) | 9.5 | Resin E (3) | 0.5 | (5-2) | 9 | Methyl benzoate | 10 | THF | 100 |
| 185 | Resin A (1) | 9.5 | Resin E (2) | 0.5 | (5-2) | 9 | Methyl benzoate | 10 | THF | 100 |
| 186 | Resin A (1) | 9.5 | Resin D (4) | 0.5 | (5-2) | 9 | Methyl benzoate | 10 | THF | 100 |
| 187 | Resin A (1) | 9.5 | Resin E (3) | 0.5 | (5-3) | 9 | Methyl benzoate | 10 | THF | 100 |
| 188 | Resin A (1) | 9.5 | Resin E (3) | 0.5 | (5-3) | 9 | Benzyl acetate | 10 | THF | 100 |
| 189 | Resin A (1) | 9.5 | Resin E (3) | 0.5 | (5-3) | 9 | Ethyl 3-ethoxypropionate | 10 | THF | 100 |
| 190 | Resin A (1) | 9.5 | Resin E (3) | 0.5 | (5-3) | 9 | Diethylene glycol ethyl methyl ether | 10 | THF | 100 |
| 191 | Resin A (1) | 9.5 | Resin E (1) | 0.5 | (5-2) | 10 | Methyl benzoate | 2 | THF | 100 |
| 192 | Resin A (1) | 9.5 | Resin E (1) | 0.5 | (5-2) | 4 | Methyl benzoate | 15 | THF | 100 |
| 193 | Resin A (1) | 9.5 | Resin E (2) | 0.5 | (5-2) | 10 | Methyl benzoate | 2 | THF | 100 |
| 194 | Resin A (1) | 9.5 | Resin E (2) | 0.5 | (5-2) | 4 | Methyl benzoate | 15 | THF | 100 |

Comparative Examples 1 to 10

Except that the component β was not used and the types of the component α, the component γ, the polycarbonate resin A, the polyester resin B, and the solvent in Example 1 were changed as shown in Table 8, an electrophotographic photosensitive member was manufactured in the same way as in Example 1. The evaluation results are shown in Table 14.

Comparative Examples 11 to 25

Except that the component β was changed to a compound other than the component β and the component α, the component γ, the polycarbonate resin A, the polyester resin B, and the solvent in Example 1 were changed as shown in Table 8, an electrophotographic photosensitive member was manufactured in the same way as in Example 1. The evaluation results are shown in Table 14.

TABLE 8

| Comp. | Polycarbonate/Polyester resin | | | | | | Compound other than | | | |
|---|---|---|---|---|---|---|---|---|---|---|
| | Resin A/Resin B | | Resin D/Resin E | | Component α | | β | | Solvent | |
| Example | Resin type | Parts | Resin type | Parts | Type | Parts | Type | Parts | Type | Parts |
| 1 | Resin A | 9.5 | Resin D | 0.5 | (1-3) | 9 | — | — | THF | 100 |
| 2 | Resin A (1) | 9.5 | Resin D (1) | 0.5 | (1-3) | 9 | — | — | THF/Toluene | 80/20 |
| 3 | Resin A | 9.5 | Resin D | 0.5 | (2-1) | 9 | — | — | THF | 100 |
| 4 | Resin A (1) | 9.5 | Resin D (1) | 0.5 | (2-1) | 9 | — | — | THF/Toluene | 80/20 |
| 5 | Resin B | 9.5 | Resin E | 0.5 | (3-1) | 5 | — | — | THF | 100 |
| 6 | Resin B (3) | 9.5 | Resin E (3) | 0.5 | (3-1) | 5 | — | — | THF/Toluene | 80/20 |
| 7 | Resin B | 9.5 | Resin E | 0.5 | (4-2) | 5 | — | — | THF | 100 |
| 8 | Resin B (3) | 9.5 | Resin E (3) | 0.5 | (4-2) | 5 | — | — | THF/Toluene | 80/20 |

TABLE 8-continued

| Comp. | Polycarbonate/Polyester resin | | | | Compound other than | | | | | |
|---|---|---|---|---|---|---|---|---|---|---|
| | Resin A/Resin B | | Resin D/Resin E | | Component α | | β | | Solvent | |
| Example | Resin type | Parts | Resin type | Parts | Type | Parts | Type | Parts | Type | Parts |
| 9 | Resin A | 9.5 | Resin E | 0.5 | (5-2) | 9 | — | — | THF | 100 |
| 10 | Resin A (1) | 9.5 | Resin E (3) | 0.5 | (5-2) | 9 | — | — | THF/Toluene | 80/20 |
| 11 | Resin A | 9.5 | Resin D | 0.5 | (1-3) | 9 | Monoglyme | 10 | THF | 100 |
| 12 | Resin A | 9.5 | Resin D | 0.5 | (1-3) | 9 | n-Pentyl acetate | 10 | THF | 100 |
| 13 | Resin A | 9.5 | Resin D | 0.5 | (1-3) | 9 | 1-Pentanol | 10 | THF | 100 |
| 14 | Resin A | 9.5 | Resin D | 0.5 | (2-1) | 9 | Monoglyme | 10 | THF | 100 |
| 15 | Resin A | 9.5 | Resin D | 0.5 | (2-1) | 9 | n-Pentyl acetate | 10 | THF | 100 |
| 16 | Resin A | 9.5 | Resin D | 0.5 | (2-1) | 9 | 1-Pentanol | 10 | THF | 100 |
| 17 | Resin B | 9.5 | Resin E | 0.5 | (3-1) | 5 | Monoglyme | 10 | THF | 100 |
| 18 | Resin B | 9.5 | Resin E | 0.5 | (3-1) | 5 | n-Pentyl acetate | 10 | THF | 100 |
| 19 | Resin B | 9.5 | Resin E | 0.5 | (3-1) | 5 | 1-Pentanol | 10 | THF | 100 |
| 20 | Resin B | 9.5 | Resin E | 0.5 | (4-2) | 5 | Monoglyme | 10 | THF | 100 |
| 21 | Resin B | 9.5 | Resin E | 0.5 | (4-2) | 5 | n-Pentyl acetate | 10 | THF | 100 |
| 22 | Resin B | 9.5 | Resin E | 0.5 | (4-2) | 5 | 1-Pentanol | 10 | THF | 100 |
| 23 | Resin A | 9.5 | Resin E | 0.5 | (5-2) | 9 | Monoglyme | 10 | THF | 100 |
| 24 | Resin A | 9.5 | Resin E | 0.5 | (5-2) | 9 | n-Pentyl acetate | 10 | THF | 100 |
| 25 | Resin A | 9.5 | Resin E | 0.5 | (5-2) | 9 | 1-Pentanol | 10 | THF | 100 |

Reference Example 1

Except that the component α in Example 1 was changed to the following CTM-6 and CTM-7, an electrophotographic photosensitive member was manufactured in the same way as in Example 1. The evaluation results are shown in Table 15.

(CTM-6)

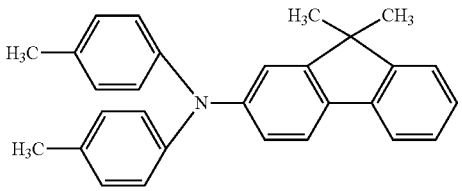

-continued (CTM-7)

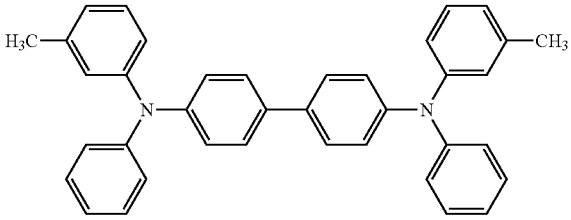

Reference Examples 2 and 3

Except that the types of the component γ, the polycarbonate resin A, the polyester resin B, and the solvent in Reference Example 1 were changed as shown in Table 9, an electrophotographic photosensitive member was manufactured in the same way as in Reference Example 1. The evaluation results are shown in Table 15.

TABLE 9

| Reference | Polycarbonate/Polyester resin | | | | Component | | Component | | | |
|---|---|---|---|---|---|---|---|---|---|---|
| | Resin A/Resin B | | Resin D/Resin E | | α | | β | | Solvent | |
| Example | Resin type | Parts | Resin type | Parts | Type | Parts | Type | Parts | Type | Parts |
| 1 | Resin A (1) | 9.5 | Resin D (1) | 0.5 | CTM-6/CTM-7 | 6/3 | — | — | THF | 100 |
| 2 | Resin A (1) | 9.5 | Resin D (1) | 0.5 | CTM-6/CTM-7 | 6/3 | — | — | THF/Toluene | 80/20 |
| 3 | Resin B (3) | 9.5 | Resin E (3) | 0.5 | CTM-6/CTM-7 | 6/3 | — | — | THF | 100 |

TABLE 10

| Example | Kinetic friction coefficient | Positive memory image | Positive memory reduction rate (%) | Amount of β (mass %) |
|---|---|---|---|---|
| 1 | 0.15 | A | 91% | 0.120% |
| 2 | 0.14 | A | 80% | 0.010% |
| 3 | 0.12 | A | 85% | 0.200% |
| 4 | 0.14 | A | 82% | 0.110% |
| 5 | 0.13 | A | 82% | 0.120% |
| 6 | 0.15 | A | 83% | 0.100% |
| 7 | 0.14 | A | 81% | 0.100% |
| 8 | 0.15 | A | 85% | 0.100% |
| 9 | 0.12 | A | 82% | 0.130% |
| 10 | 0.13 | A | 81% | 0.110% |
| 11 | 0.13 | A | 84% | 0.100% |
| 12 | 0.17 | B | 79% | 0.140% |
| 13 | 0.18 | B | 78% | 0.120% |
| 14 | 0.18 | B | 75% | 0.140% |
| 15 | 0.20 | A | 78% | 0.120% |
| 16 | 0.19 | A | 79% | 0.110% |
| 17 | 0.18 | B | 68% | 0.120% |
| 18 | 0.17 | B | 78% | 0.110% |
| 19 | 0.22 | A | 79% | 0.140% |
| 20 | 0.21 | B | 78% | 0.140% |
| 21 | 0.20 | B | 76% | 0.110% |
| 22 | 0.21 | A | 77% | 0.080% |
| 23 | 0.17 | B | 69% | 0.110% |
| 24 | 0.16 | B | 69% | 0.120% |
| 25 | 0.14 | A | 90% | 0.110% |
| 26 | 0.08 | A | 88% | 0.080% |
| 27 | 0.11 | A | 86% | 0.100% |
| 28 | 0.13 | A | 87% | 0.130% |
| 29 | 0.12 | A | 83% | 0.150% |
| 30 | 0.15 | A | 85% | 0.100% |
| 31 | 0.14 | A | 83% | 0.120% |
| 32 | 0.13 | A | 81% | 0.100% |
| 33 | 0.12 | A | 81% | 0.110% |
| 34 | 0.15 | A | 82% | 0.100% |
| 35 | 0.17 | A | 77% | 0.090% |
| 36 | 0.14 | A | 83% | 0.110% |
| 37 | 0.12 | A | 84% | 0.150% |
| 38 | 0.13 | A | 88% | 0.130% |
| 39 | 0.13 | A | 83% | 0.110% |
| 40 | 0.15 | A | 83% | 0.160% |
| 41 | 0.14 | A | 86% | 0.130% |
| 42 | 0.15 | A | 80% | 0.100% |
| 43 | 0.14 | A | 81% | 0.130% |
| 44 | 0.11 | A | 81% | 0.110% |
| 45 | 0.13 | A | 80% | 0.001% |
| 46 | 0.15 | B | 75% | 2.550% |
| 47 | 0.13 | A | 84% | 0.140% |
| 48 | 0.15 | A | 86% | 0.010% |
| 49 | 0.10 | A | 88% | 0.220% |
| 50 | 0.13 | A | 82% | 0.120% |
| 51 | 0.13 | A | 80% | 0.120% |
| 52 | 0.14 | A | 79% | 0.100% |
| 53 | 0.12 | A | 80% | 0.130% |
| 54 | 0.14 | A | 81% | 0.110% |
| 55 | 0.12 | A | 79% | 0.130% |
| 56 | 0.14 | A | 78% | 0.140% |
| 57 | 0.13 | A | 78% | 0.120% |
| 58 | 0.18 | B | 79% | 0.150% |
| 59 | 0.16 | A | 77% | 0.110% |
| 60 | 0.19 | B | 69% | 0.130% |
| 61 | 0.21 | B | 78% | 0.120% |
| 62 | 0.20 | A | 79% | 0.110% |
| 63 | 0.22 | A | 77% | 0.130% |
| 64 | 0.18 | B | 68% | 0.140% |
| 65 | 0.19 | B | 69% | 0.110% |
| 66 | 0.16 | B | 77% | 0.130% |
| 67 | 0.17 | B | 79% | 0.110% |
| 68 | 0.16 | A | 78% | 0.090% |
| 69 | 0.18 | A | 79% | 0.120% |
| 70 | 0.16 | A | 76% | 0.130% |
| 71 | 0.14 | A | 85% | 0.140% |
| 72 | 0.08 | A | 84% | 0.080% |
| 73 | 0.14 | A | 83% | 0.100% |
| 74 | 0.15 | A | 81% | 0.130% |
| 75 | 0.13 | A | 83% | 0.140% |

TABLE 10-continued

| Example | Kinetic friction coefficient | Positive memory image | Positive memory reduction rate (%) | Amount of β (mass %) |
|---|---|---|---|---|
| 76 | 0.12 | A | 81% | 0.100% |
| 77 | 0.13 | A | 83% | 0.130% |
| 78 | 0.11 | A | 87% | 0.110% |
| 79 | 0.13 | A | 80% | 0.110% |
| 80 | 0.18 | A | 77% | 0.100% |
| 81 | 0.18 | A | 73% | 0.140% |
| 82 | 0.13 | A | 83% | 0.130% |
| 83 | 0.11 | A | 84% | 0.150% |
| 84 | 0.14 | A | 81% | 0.140% |
| 85 | 0.19 | A | 75% | 0.130% |

TABLE 11

| Example | Kinetic friction coefficient | Positive memory image | Positive memory reduction rate (%) | Amount of β (mass %) |
|---|---|---|---|---|
| 86 | 0.15 | A | 83% | 0.160% |
| 87 | 0.13 | A | 83% | 0.010% |
| 88 | 0.09 | A | 85% | 0.230% |
| 89 | 0.15 | A | 83% | 0.110% |
| 90 | 0.11 | A | 80% | 0.120% |
| 91 | 0.13 | A | 88% | 0.100% |
| 92 | 0.14 | A | 86% | 0.110% |
| 93 | 0.13 | A | 81% | 0.090% |
| 94 | 0.14 | A | 81% | 0.130% |
| 95 | 0.15 | A | 83% | 0.120% |
| 96 | 0.10 | A | 80% | 0.110% |
| 97 | 0.17 | B | 79% | 0.140% |
| 98 | 0.20 | A | 77% | 0.150% |
| 99 | 0.16 | B | 72% | 0.130% |
| 100 | 0.16 | B | 73% | 0.110% |
| 101 | 0.22 | A | 79% | 0.110% |
| 102 | 0.17 | A | 78% | 0.160% |
| 103 | 0.16 | B | 77% | 0.140% |
| 104 | 0.17 | A | 79% | 0.130% |
| 105 | 0.20 | B | 69% | 0.140% |
| 106 | 0.21 | B | 71% | 0.160% |
| 107 | 0.19 | B | 68% | 0.130% |
| 108 | 0.17 | A | 78% | 0.140% |
| 109 | 0.16 | B | 76% | 0.140% |
| 110 | 0.11 | A | 82% | 0.130% |
| 111 | 0.13 | A | 86% | 0.100% |
| 112 | 0.15 | A | 86% | 0.120% |
| 113 | 0.14 | A | 83% | 0.130% |
| 114 | 0.13 | A | 82% | 0.140% |
| 115 | 0.12 | A | 87% | 0.110% |
| 116 | 0.13 | A | 83% | 0.150% |
| 117 | 0.10 | A | 86% | 0.110% |
| 118 | 0.11 | A | 81% | 0.100% |
| 119 | 0.12 | A | 86% | 0.130% |
| 120 | 0.17 | A | 77% | 0.110% |
| 121 | 0.14 | A | 83% | 0.130% |
| 122 | 0.15 | A | 85% | 0.010% |
| 123 | 0.09 | A | 87% | 0.220% |
| 124 | 0.15 | A | 80% | 0.110% |
| 125 | 0.13 | A | 83% | 0.110% |
| 126 | 0.11 | A | 88% | 0.140% |
| 127 | 0.11 | A | 81% | 0.130% |
| 128 | 0.15 | A | 84% | 0.160% |
| 129 | 0.14 | A | 88% | 0.120% |
| 130 | 0.15 | A | 83% | 0.110% |
| 131 | 0.14 | A | 82% | 0.140% |
| 132 | 0.20 | A | 79% | 0.110% |
| 133 | 0.18 | A | 78% | 0.150% |
| 134 | 0.18 | A | 78% | 0.130% |
| 135 | 0.19 | A | 77% | 0.140% |
| 136 | 0.17 | B | 79% | 0.160% |
| 137 | 0.19 | B | 76% | 0.140% |
| 138 | 0.16 | B | 78% | 0.110% |
| 139 | 0.17 | A | 78% | 0.170% |

TABLE 11-continued

| Example | Kinetic friction coefficient | Positive memory image | Positive memory reduction rate (%) | Amount of β (mass %) |
|---|---|---|---|---|
| 140 | 0.19 | B | 74% | 0.130% |
| 141 | 0.21 | B | 69% | 0.120% |
| 142 | 0.16 | B | 69% | 0.090% |
| 143 | 0.20 | B | 77% | 0.100% |
| 144 | 0.22 | B | 79% | 0.110% |
| 145 | 0.14 | A | 84% | 0.110% |
| 146 | 0.13 | A | 82% | 0.130% |
| 147 | 0.15 | A | 83% | 0.120% |
| 148 | 0.11 | A | 82% | 0.110% |
| 149 | 0.14 | A | 81% | 0.170% |
| 150 | 0.13 | A | 85% | 0.160% |
| 151 | 0.14 | A | 88% | 0.120% |
| 152 | 0.11 | A | 81% | 0.100% |
| 153 | 0.12 | A | 86% | 0.140% |
| 154 | 0.15 | A | 83% | 0.110% |
| 155 | 0.19 | A | 75% | 0.180% |

TABLE 12

| Example | Kinetic friction coefficient | Positive memory image | Positive memory reduction rate (%) | Amount of β (mass %) |
|---|---|---|---|---|
| 156 | 0.14 | A | 81% | 0.120% |
| 157 | 0.15 | A | 84% | 0.010% |
| 158 | 0.10 | A | 88% | 0.240% |
| 159 | 0.14 | A | 83% | 0.140% |
| 160 | 0.15 | A | 80% | 0.120% |
| 161 | 0.13 | A | 83% | 0.100% |
| 162 | 0.14 | A | 84% | 0.110% |
| 163 | 0.11 | A | 81% | 0.150% |
| 164 | 0.10 | A | 82% | 0.130% |
| 165 | 0.14 | A | 86% | 0.120% |
| 166 | 0.15 | A | 81% | 0.160% |
| 167 | 0.20 | B | 79% | 0.140% |
| 168 | 0.22 | A | 78% | 0.170% |
| 169 | 0.18 | B | 79% | 0.140% |
| 170 | 0.17 | B | 78% | 0.140% |
| 171 | 0.16 | A | 79% | 0.160% |
| 172 | 0.21 | A | 79% | 0.120% |
| 173 | 0.19 | B | 69% | 0.130% |
| 174 | 0.18 | B | 68% | 0.120% |
| 175 | 0.20 | B | 69% | 0.120% |
| 176 | 0.22 | A | 78% | 0.110% |
| 177 | 0.19 | B | 72% | 0.110% |
| 178 | 0.16 | B | 77% | 0.110% |
| 179 | 0.18 | B | 77% | 0.100% |
| 180 | 0.11 | A | 81% | 0.110% |
| 181 | 0.13 | A | 83% | 0.090% |
| 182 | 0.13 | A | 83% | 0.130% |
| 183 | 0.14 | A | 82% | 0.120% |
| 184 | 0.14 | A | 84% | 0.140% |
| 185 | 0.12 | A | 82% | 0.110% |
| 186 | 0.15 | A | 83% | 0.120% |
| 187 | 0.14 | A | 88% | 0.100% |
| 188 | 0.12 | A | 83% | 0.140% |
| 189 | 0.11 | A | 85% | 0.110% |
| 190 | 0.18 | A | 78% | 0.180% |
| 191 | 0.14 | A | 86% | 0.080% |
| 192 | 0.08 | A | 88% | 0.250% |
| 193 | 0.13 | A | 81% | 0.090% |
| 194 | 0.09 | A | 89% | 0.240% |

TABLE 13

| Comparative Example | Kinetic friction coefficient | Positive memory image | Positive memory reduction rate (%) | Amount of components other then β |
|---|---|---|---|---|
| 1 | 0.22 | C | 69% | — |
| 2 | 0.24 | C | 60% | — |
| 3 | 0.23 | D | 53% | — |
| 4 | 0.25 | D | 51% | — |
| 5 | 0.26 | C | 70% | — |
| 6 | 0.23 | D | 50% | — |
| 7 | 0.26 | C | 69% | — |
| 8 | 0.25 | C | 73% | — |
| 9 | 0.24 | C | 63% | — |
| 10 | 0.22 | D | 50% | — |

| Comparative Example | Kinetic friction coefficient | Positive memory image | Positive memory reduction rate (%) | Amount of components other then β (mass %) |
|---|---|---|---|---|
| 11 | 0.23 | C | 63% | 0.140% |
| 12 | 0.23 | D | 52% | 0.120% |
| 13 | 0.21 | C | 73% | 0.122% |
| 14 | 0.25 | D | 51% | 0.120% |
| 15 | 0.22 | D | 69% | 0.150% |
| 16 | 0.22 | C | 73% | 0.130% |
| 17 | 0.23 | C | 71% | 0.150% |
| 18 | 0.24 | C | 64% | 0.130% |
| 19 | 0.23 | C | 59% | 0.100% |
| 20 | 0.26 | C | 59% | 0.128% |
| 21 | 0.25 | D | 71% | 0.130% |
| 22 | 0.23 | D | 64% | 0.132% |
| 23 | 0.22 | C | 73% | 0.138% |
| 24 | 0.24 | D | 51% | 0.140% |
| 25 | 0.26 | C | 75% | 0.142% |

TABLE 14

| Reference Example | Kinetic friction coefficient | Positive memory image | Positive memory reduction rate (%) | Amount of β (mass %) |
|---|---|---|---|---|
| 1 | 0.22 | A | 88% | — |
| 2 | 0.21. | A | 89% | — |
| 3 | 0.19 | A | 88% | — |

From the comparison between the Examples and the Comparative Examples, it is shown that the surface layer of an electrophotographic photosensitive member including the component α, the component β, and the component γ exhibits an excellent effect on both of the reduction in initial friction coefficient and the suppression of positive memory.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-007316, filed Jan. 18, 2013, which is hereby incorporated by reference herein in its entirety.

What is claimed is:

1. An electrophotographic photosensitive member comprising:

a support;

a charge generating layer formed on the support; and a charge transporting layer formed on the charge generating layer;

wherein the charge transporting layer is a surface layer, and the surface layer comprises:

(α) at least one charge transporting substance selected from the group consisting of a compound represented by the following formula (1), a compound represented by the following formula (2), a compound represented by the following formula (3), a compound represented by the following formula (4) and a compound represented by the following formula (5);

(β) at least one compound selected from the group consisting of hexanol, heptanol, cyclohexanol, benzyl alcohol, ethylene glycol, 1,4-butanediol, 1,5-pentanediol, diethylene glycol, diethylene glycol ethyl methyl ether, ethylene carbonate, propylene carbonate, nitrobenzene, pyrrolidone, N-methylpyrrolidone, methyl benzoate, ethyl benzoate, benzyl acetate, ethyl 3-ethoxypropionate, acetophenone, methyl salicylate, dimethyl phthalate, and sulfolane; and (γ) at least one resin selected from the group consisting of a polycarbonate resin having a siloxane moiety at the end, and a polyester resin having a siloxane moiety at the end;

(1)

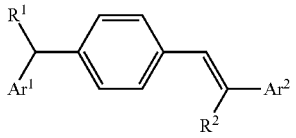

(2)

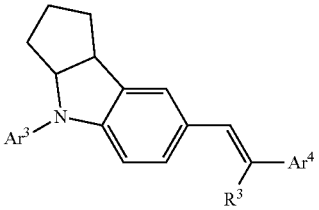

(3)

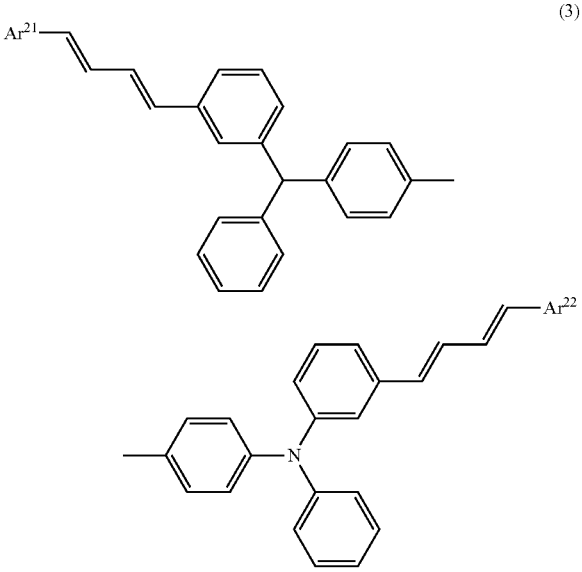

(4)

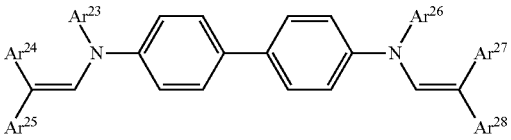

(5)

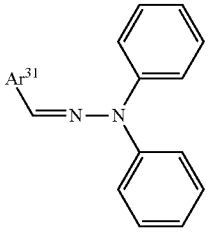

where, $Ar^1$ and $Ar^3$ each independently represent a phenyl group, or a phenyl group substituted with a methyl group, an ethyl group, or an ethoxy group, $Ar^2$ and $Ar^4$ each independently represent a phenyl group, a phenyl group substituted with a methyl group, a phenyl group substituted with a univalent group represented by the formula "—CH═CH—Ta", or a biphenylyl group substituted with a univalent group represented by the formula "—CH═CH—Ta" (where, Ta represents an univalent group derived from a benzene ring of a triphenylamine by loss of one hydrogen atom, or derived from a benzene ring of a triphenylamine substituted with a methyl group or an ethyl group by loss of one hydrogen atom), $R^1$ represents a phenyl group, a phenyl group substituted with a methyl group, or a phenyl group substituted with a univalent group represented by the formula "—CH═C($Ar^5$)$Ar^6$" (where, $Ar^5$ and $Ar^6$ each independently represent a phenyl group or a phenyl group substituted with a methyl group), and $R^2$ and $R^3$ each independently represent a hydrogen atom, a phenyl group, or a phenyl group substituted with a methyl group;

where, $Ar^{21}$ and $Ar^{22}$ each independently represent a phenyl group, or a phenyl group substituted with a methyl group, $Ar^{23}$ to $Ar^{28}$ each independently represent a phenyl group, or a phenyl group substituted with a methyl group, $Ar^{31}$ represents a phenyl group substituted with a univalent group derived from a benzene ring of a triphenylamine by loss of one hydrogen atom, a phenyl group substituted with a univalent group derived from a benzene ring of a triphenylamine substituted with a methyl group or an ethyl group by loss of one hydrogen atom, or a methylcarbazolyl group.

2. The electrophotographic photosensitive member according to claim 1, wherein the compound of the (β) is at least one compound selected from the group consisting of cyclohexanol, benzyl alcohol, methyl benzoate, ethyl benzoate, benzyl acetate, ethyl 3-ethoxypropionate, acetophenone, methyl salicylate, and dimethyl phthalate.

3. The electrophotographic photosensitive member according to claim 1, wherein the content of the compound of the (β) is 0.001 mass% or more and 2.0 mass% or less relative to the total mass of the surface layer.

4. The electrophotographic photosensitive member according to claim 1, wherein the polycarbonate resin having a siloxane moiety at the end is a polycarbonate resin D having a structural unit represented by the following formula (A) and an end structure represented by the following formula (D):

(A)

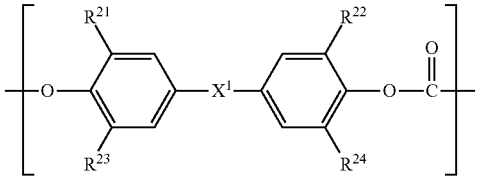

where, $R^{21}$ to $R^{24}$ each independently represent a hydrogen atom or a methyl group, and $X^1$ represents a single bond, a cyclohexylidene group, or a divalent group having a structure represented by the following formula (C);

(C)

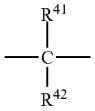

where, $R^{41}$ and $R^{42}$ each independently represent a hydrogen atom, a methyl group, or a phenyl group;

(D)

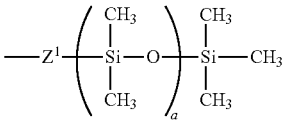

where,

"a" represents the number of times the structure in parentheses is repeated, the average of "a" is 1 or more and 500 or less for the polycarbonate resin D, and $Z^1$ represents a divalent organic group.

5. The electrophotographic photosensitive member according to claim 4, wherein the $Z^1$ is a divalent group represented by the following formula (E):

(E)

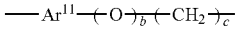

where, $Ar^{11}$ represents a substituted or unsubstituted arylene group, the substituent of the substituted arylene group represents a phenoxy group or a phenyl carbonyl group, "b" represents 0 or 1, "c" represents the number of times the structure in parentheses is repeated, and the average of "c" is 1 or more and 10 or less for the polycarbonate resin D.

6. The electrophotographic photosensitive member according to claim 1, wherein the polyester resin having a siloxane moiety at the end is a polyester resin E having a structural unit represented by the following formula (B) and an end structure represented by the following formula (D):

(B)

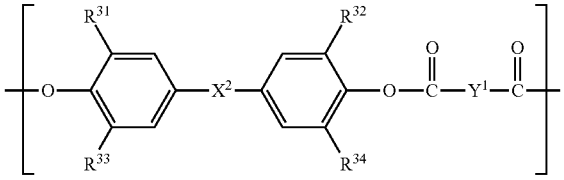

where, $R^{31}$ to $R^{34}$ each independently represent a hydrogen atom or a methyl group, $X^2$ represents a single bond, a cyclohexylidene group, or a divalent group having a structure represented by the following formula (C), and $Y^1$ represents a m-phenylene group, a p-phenylene group, or a divalent group of two p-phenylene groups bonded through an oxygen atom;

(C)

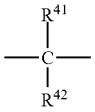

where, $R^{41}$ and $R^{42}$ each independently represent a hydrogen atom, a methyl group, or a phenyl group;

(D)

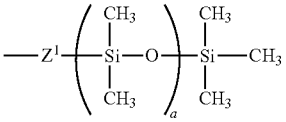

where,

"a" represents the number of times the structure in parentheses is repeated, the average of "a" is 1 or more and 500 or less for the polyester resin E, and $Z^1$ represents a divalent organic group.

7. The electrophotographic photosensitive member according to claim 6, wherein the $Z^1$ is a divalent group represented by the following formula (E):

(E)

where, $Ar^{11}$ represents a substituted or unsubstituted arylene group, the substituent of the substituted arylene group represents a phenoxy group or a phenyl carbonyl group, "b" represents 0 or 1, "c" represents the number of times the structure in parentheses is repeated, and the average of "c" is 1 or more and 10 or less for the polyester resin E.

8. The electrophotographic photosensitive member according to claim 1, wherein the content of the charge transporting substance of the (α) in the surface layer is 10 mass% or more and 800 mass% or less relative to the mass of the compound of the (β).

9. A process cartridge integrally supporting the electrophotographic photosensitive member according to claim 1, and at least one device selected from the group consisting of a charging device, a developing device, and a cleaning device, the process cartridge being detachably mountable to a main body of an electrophoto graphic apparatus.

10. An electrophotographic apparatus comprising the electrophotographic photosensitive member according to claim 1, and a charging device, an exposure device, a developing device, and a transfer device.

* * * * *